US006656098B2

(12) United States Patent
Hoffman

(10) Patent No.: US 6,656,098 B2
(45) Date of Patent: Dec. 2, 2003

(54) RESTRAINT AND EXERCISE DEVICE

(75) Inventor: Jonathan Hoffman, Sunnyvale, CA (US)

(73) Assignee: BackProject Corporation, Sunnyvale, CA (US)

( * ) Notice: Subject to any disclaimer, the term of this patent is extended or adjusted under 35 U.S.C. 154(b) by 0 days.

(21) Appl. No.: 10/157,860

(22) Filed: May 31, 2002

(65) Prior Publication Data

US 2002/0183177 A1 Dec. 5, 2002

Related U.S. Application Data

(60) Provisional application No. 60/330,423, filed on Oct. 22, 2001, and provisional application No. 60/301,392, filed on Jun. 26, 2001.

(30) Foreign Application Priority Data

Jun. 1, 2001 (EP) ..... 01650069
Oct. 19, 2001 (IE) ..... 20010923

(51) Int. Cl.[7] ..... A63B 71/00

(52) U.S. Cl. ..... 482/148; 128/845; 128/846; 482/142

(58) Field of Search ..... 482/148, 142; 128/845–846, 869–870, 876

(56) References Cited

U.S. PATENT DOCUMENTS

| | | | | |
|---|---|---|---|---|
| 30,601 | A | 11/1860 | Wright | |
| 32,014 | A | 4/1861 | Taylor | |
| 32,015 | A | 4/1861 | Taylor | |
| 41,548 | A | 2/1864 | Taylor | |
| 1,221,289 | A | 4/1917 | Clough | |
| 1,530,519 | A | 3/1925 | Remington | |
| 2,552,475 | A | 5/1951 | Austlid | 128/78 |
| 3,003,498 | A | 10/1961 | Hotas | 128/75 |
| 3,548,817 | A | 12/1970 | Mittasch | 128/75 |
| 3,709,216 | A | 1/1973 | Hilyard et al. | 128/69 |
| 3,752,153 | A | 8/1973 | Copeland | 128/24 R |
| 3,889,664 | A | 6/1975 | Heuser et al. | 128/75 |
| 3,926,182 | A | 12/1975 | Stabholz | 128/75 |
| 3,957,266 | A | 5/1976 | Rice | 272/125 |
| 4,030,489 | A | 6/1977 | Buckner | 128/75 |
| 4,207,879 | A | 6/1980 | Safadago et al. | 128/70 |
| 4,211,426 | A | 7/1980 | Motloch | 280/87.02 |
| 4,372,552 | A | 2/1983 | Carlmark | 272/112 |
| 4,372,553 | A | 2/1983 | Hatfield | 272/119 |
| 4,434,793 | A | 3/1984 | Willits | 128/134 |
| 4,674,160 | A | 6/1987 | Gibson | 272/134 |
| 4,678,186 | A | 7/1987 | McIntyre et al. | 272/134 |
| 4,725,055 | A | 2/1988 | Skowronski | 272/134 |
| 4,725,056 | A | 2/1988 | Rehrl et al. | 272/134 |
| 4,845,987 | A | 7/1989 | Kenneth | 73/379 |
| 4,858,919 | A | 8/1989 | Jones | 272/134 |
| 4,987,885 | A | 1/1991 | Shtabholz | 128/75 |
| 5,007,634 | A | 4/1991 | Jones | 272/134 |
| 5,094,249 | A | 3/1992 | Marras et al. | 128/781 |

(List continued on next page.)

FOREIGN PATENT DOCUMENTS

| | | |
|---|---|---|
| DE | 76054 | 7/1894 |
| DE | 298 03 577 U1 | 8/1999 |
| SU | 1412777 A1 | 7/1988 |
| SU | 1528483 A1 | 12/1989 |
| WO | WO 98/00087 | 1/1998 |
| WO | WO 00/28927 | 5/2000 |
| WO | WO 01/14018 A1 | 3/2001 |

*Primary Examiner*—Nicholas D. Lucchesi
*Assistant Examiner*—Lori Baker Amerson
(74) *Attorney, Agent, or Firm*—McGuireWoods LLP

(57) ABSTRACT

A restraint and exercise device is provided to treat acute or chronic mechanical pain, particularly lumbopelvic and/or leg pain, and to restore and/or increase range of motion in suitable users. The device is particularly useful during exercise. The device may contain a restraint, such as two straps, connected to a support structure. The straps help restrain a portion of a person's body such as the pelvic region. The portion of the person's body may be restrained in a substantially pain-free position so as to reduce the pain that would otherwise be felt during exercise.

18 Claims, 25 Drawing Sheets

U.S. PATENT DOCUMENTS

| | | | | |
|---|---|---|---|---|
| 5,105,803 | A | 4/1992 | Burton | 602/36 |
| 5,176,706 | A | 1/1993 | Lee | 606/237 |
| 5,217,487 | A | 6/1993 | Engel et al. | 606/240 |
| 5,224,924 | A | 7/1993 | Urso | 602/19 |
| 5,275,426 | A | 1/1994 | Tankersley | 280/87.051 |
| 5,288,074 | A | 2/1994 | Scheurer | 283/188 R |
| 5,324,247 | A | 6/1994 | Lepley | 482/134 |
| 5,387,168 | A | 2/1995 | Bostic | 482/70 |
| 5,449,335 | A | 9/1995 | Steinfeld | 482/110 |
| 5,474,086 | A | 12/1995 | McCormick et al. | 128/782 |
| 5,496,247 | A | 3/1996 | Anderson | 482/142 |
| 5,575,765 | A | 11/1996 | Foster | 602/32 |
| 5,647,375 | A | 7/1997 | Farfan de los Godos | 128/781 |
| 5,688,212 | A | 11/1997 | Walker | 482/83 |
| 5,730,688 | A | 3/1998 | Prusick | 482/130 |
| 5,776,084 | A | 7/1998 | Wolan | 601/26 |
| 5,785,665 | A | 7/1998 | Soejima | 600/594 |
| 5,868,691 | A | 2/1999 | Vishnevsky | 602/19 |
| 5,897,472 | A | 4/1999 | Thulasingam | 482/133 |
| 6,146,317 | A | 11/2000 | Prusick | 482/130 |
| 6,162,151 | A | 12/2000 | Tani et al. | 482/54 |
| 6,240,923 | B1 | 6/2001 | Barrick | 128/869 |
| 6,342,033 | B1 | 1/2002 | Walker | 482/114 |
| 6,343,802 | B1 | 2/2002 | Workman et al. | 280/87.041 |

RESTRAINT AND EXERCISE DEVICE

This application claims priority of copending U.S. Provisional applications No. 60/301,392 filed Jun. 26, 2001 and No. 60/330,423 filed Oct. 22, 2001, the contents of both of which are incorporated herein by reference.

BACKGROUND OF THE INVENTION

This invention generally relates to a restraint device. Various implementations of the invention are envisioned, including its use as a lumbopelvic restraint device during exercise to relieve pain and/or restore range of motion in lower back, pelvis, and leg pain suffers or in healthy persons who wish to restore or increase their range of motion. It may also be used to treat pain and/or restore or increase range of motion in the neck, shoulders, upper back, middle back and other body parts.

In the human anatomy, the lower spine, known as the lumbar spine, is joined to the pelvic bone at a joint known as the sacro-iliac joint. The sacro-iliac joint is a relatively stiff or rigid joint. The upper leg bone, known as the femur, is joined to the pelvic bone at the hip joint by means of hip ligaments. Only a limited degree of movement of the lumbar spine relative to the pelvis is possible at the sacro-iliac joint, due to the relatively stiff or rigid nature of this joint. Thus, in general, upon movement of the lumbar spine in any direction, at least some of this movement is translated into a movement of the pelvis at the hip joint. This is because the hip joint is relatively free-moving in comparison to the stiff sacro-iliac joint. Upon movement of the leg, at least some of the hip ligaments start to wind up. When these hip ligaments are fully wound up, further movement of the leg is translated into a movement of the pelvis.

A major and longstanding health problem that spans the world is acute or chronic back pain. A countless number of people suffer from pain in the lumbopelvic region including their lower back and hip. The causes of back pain are too numerous to enumerate, but include injuries, bad posture, accidents, genetic defects, disease, and aging. For some, the pain arises only during exercise. As a result, many eliminate beneficial exercises from their routines. For others, hip and/or lower back pain is always present. Exercise may be a desirable or a necessary treatment for the pain for many of these people. But again, the very exercises needed to alleviate the pain are difficult to perform due to the increased pain during exercise. These people often become stuck in a depressing cycle of increasing pain as the exercises and treatments needed to alleviate pain are too painful to perform, with the lack of proper exercise resulting in weakening of the muscles and increased pain and/or discomfort. The amount of money and effort spent on trying to cure back problems and/or alleviate the pain and/or discomfort is staggering. Modem medical attempts to address these issues, including drugs, surgery, traction, manual mobilization and exercise, are costly and have met with little success. There is no doubt there is a longstanding need for a safe, reliable and cost effective way to solve the problems associated with lumbopelvic back pain and disorders. Also, there is no doubt that the numerous attempts by others to meet this need and solve these problems have largely been failures.

Pelvis restraint devices have been proposed for various uses, such as those disclosed in U.S. Pat. No. 3,709,216 to Hilyard et al.; U.S. Pat. No. 4,678,186 to McIntyre et al.; U.S. Pat. No. 5,094,249 to Marras et al.; and U.S. Pat. No. 5,474,086 to McCormick et al. Among other deficiencies, none of the proposed devices suggests an apparatus capable of positioning the pelvis with six degrees of freedom in any of a number of three-dimensional positions to find a substantially pain-free position in which the pelvis may be subsequently restrained by the apparatus, and from which exercises can be performed in a substantially pain-free manner. In brief, they do not disclose a mechanical device capable of eliminating pain, exercising in a pain-free position, and directing movements to the affected joint or region of the body. In addition, these and similar devices may suffer from one or more additional drawbacks. First, the number of exercises available to the user is limited. Second, some of the devices are not user-friendly. Third, some of the devices are unable to conform to a user's build and preferences. Fourth, the devices do not do a sufficient job of preventing pain in the user.

SUMMARY OF INVENTION

The invention meets the needs described above for a vast number of suitable back, pelvis, and/or leg pain suffers, and avoids the problems and disadvantages of the prior art, by provision of a mechanical device that allows a user, with or without the help of a physician, clinician, physical therapist or other healthcare professional, to position and stabilize his/her body in a substantially or completely pain-free position. The stabilized position of the body is then restrained so as to maintain its position, and exercises of other body parts relative to the restrained region may be performed substantially or completely pain-free. In particular, exercises may now be directed to the specific area of the body region that has been causing pain. In some suitable users, these and other similar exercises have produced remarkable and immediate results in terms of elimination or reduction of pain and restoration or increased range of motion.

The principles of invention may be implemented in a number of ways.

In one example, a support body and a restraining device restrain a body portion. The restraining device may include two straps spaced apart, each of which may be coupled to both sides of the support body. The straps restrain a portion of a user's body—most commonly the pelvis—against the support body. Each strap has buckles that allow the straps to be opened and closed. Each strap is also adjustable in a number of ways. The straps adjust to the user's build, in part, by moving up and down with respect to the user's height and/or to the required level of restraint. Accordingly, each strap also may include two leverage points for adjusting the tension in the strap. Ratchets can be used to provide the leverage points—in this example, at each side of the person. After buckling the straps and placing them over the pelvis region, each ratchet may be tightened and loosened in order to position and restrain the pelvis in a comfortable position whereby any pain that otherwise would have existed is lessened or eliminated. This is accomplished in part because the ratchets adjust the tension of the straps along either side of the user, causing a slight rotation and repositioning of the pelvis. Adjustment of the height of the ratchets and tension in the straps in combination enables a three-dimensional repositioning of the pelvic or other body area until the pain is reduced. Once a comfortable, preferable pain-free position is reached, all of the ratchets may be tightened evenly to maintain the comfortable position.

The user then may perform any number of exercises or movements (stretching and twisting exercises, weight lifting, etc.). Because the pelvis is restrained, exercising directs the movements to one or more joints. For example, during back exercises, movement about the hip joint is inhibited. Most of the exercising movement of the user's lumbar back region is translated into a pivoting of the spine itself, and about the pelvis at the sacro-iliac joint. This would not normally be the case. If the pelvis was not restrained, some of the movement of the lumbar spine region would be translated into a movement of the pelvis at the hip joint. This is because the hip joint is relatively free-moving in comparison to the relatively stiff sacro-iliac joint. These and similar exercises are a useful therapy for those with back or other physical problems, and may even be used for those without back problems, for example, to increase range of motion.

Other features may be implemented to improve the benefits of the device. One or more additional straps connected to the support body may be placed around another part of the user's body to improve the exercise routines. For instance a strap could be placed around the user's chest, leg, or arm. The strap may include a resilient portion so that when, for example, the strap is around the user's chest, the user can move his or her chest in many different directions. However, the resilient portion provides resistance to the movements. This strap may be designed to be easily releasable from the user—no matter the user's position on the support body. Other accessories may also be provided. For example, a footstool for elevating the user's leg and a pivotable leg support for twisting the user's leg could be utilized. A chair could also be provided to allow the user to sit while exercising.

Additional and alternative features, advantages, and embodiments of the invention are set forth in the following detailed description, drawings, and claims, including methods of using the invention to treat pain in injured persons or increase range of motion in healthy persons. Although numerous implementations and examples of the invention are set forth in the patent including in this "Summary of Invention" section—the examples and implementations are not intended to limit the scope of the invention.

BRIEF DESCRIPTION OF THE DRAWINGS

The accompanying drawings, which are included to provide a further understanding of the invention and are incorporated in and constitute a part of this specification, illustrate preferred embodiments of the invention and together with the detailed description served to explain the principles of the invention. In the drawings.

DETAILED DESCRIPTION OF PREFERRED EMBODIMENTS OF THE INVENTION

The drawings illustrate various embodiments of a device for holding the pelvis of a user in any of a number of substantially fixed positions during exercise—for example, leg or back exercises. As a result, the user's pelvis is substantially inhibited from pivoting about the hip joint during back exercises. Instead, most of the exercising movement of the user's back is translated into a pivoting of the spine itself, and about the pelvis at the sacro-iliac joint. Similarly, during leg exercises the device ensures that substantially all movement of the leg is translated into a pivoting of the leg about the pelvis. In this case, the user's pelvis is substantially inhibited from pivoting about the sacro-iliac joint and lumbar spine. In other cases, the restraining belts can be used to inhibit movement from spinal segments between the belts, and facilitate movement at other segments above or below the belts. The user may be a patient suffering from pain or a healthy person who wishes to perform exercises that may increase range of motion.

In order to increase its therapeutic effect, the device is adjustable to help position and secure the user in a substantially pain-free position. Hence, those who previously had to endure pain—even excruciating pain—may be able to perform subsequent exercising movements on the device in a substantially pain-free manner. The therapeutic effects on suitable users from performing these substantially pain-free exercises has been dramatic in terms of reduction of pain and/or increase in range of motion. In some cases, the results have been immediate and have completely eliminated pain and restored full range of motion of users having chronic pain after a short period of treatment with the invention.

Figure 1:
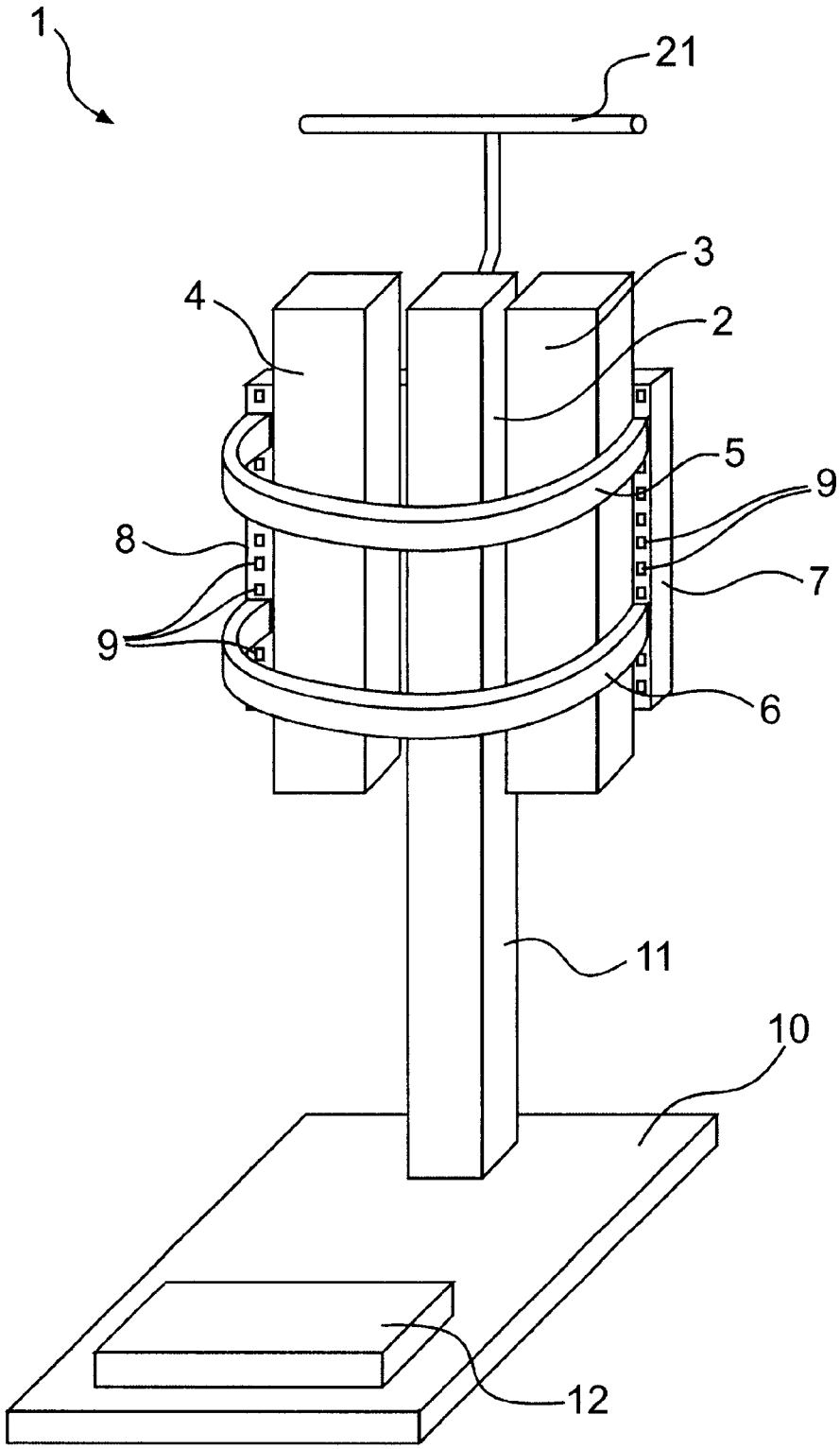
FIG. 1 is a perspective view of a lumbopelvic restraining and exercise device constructed according to the principles to the invention.
Figure 2:
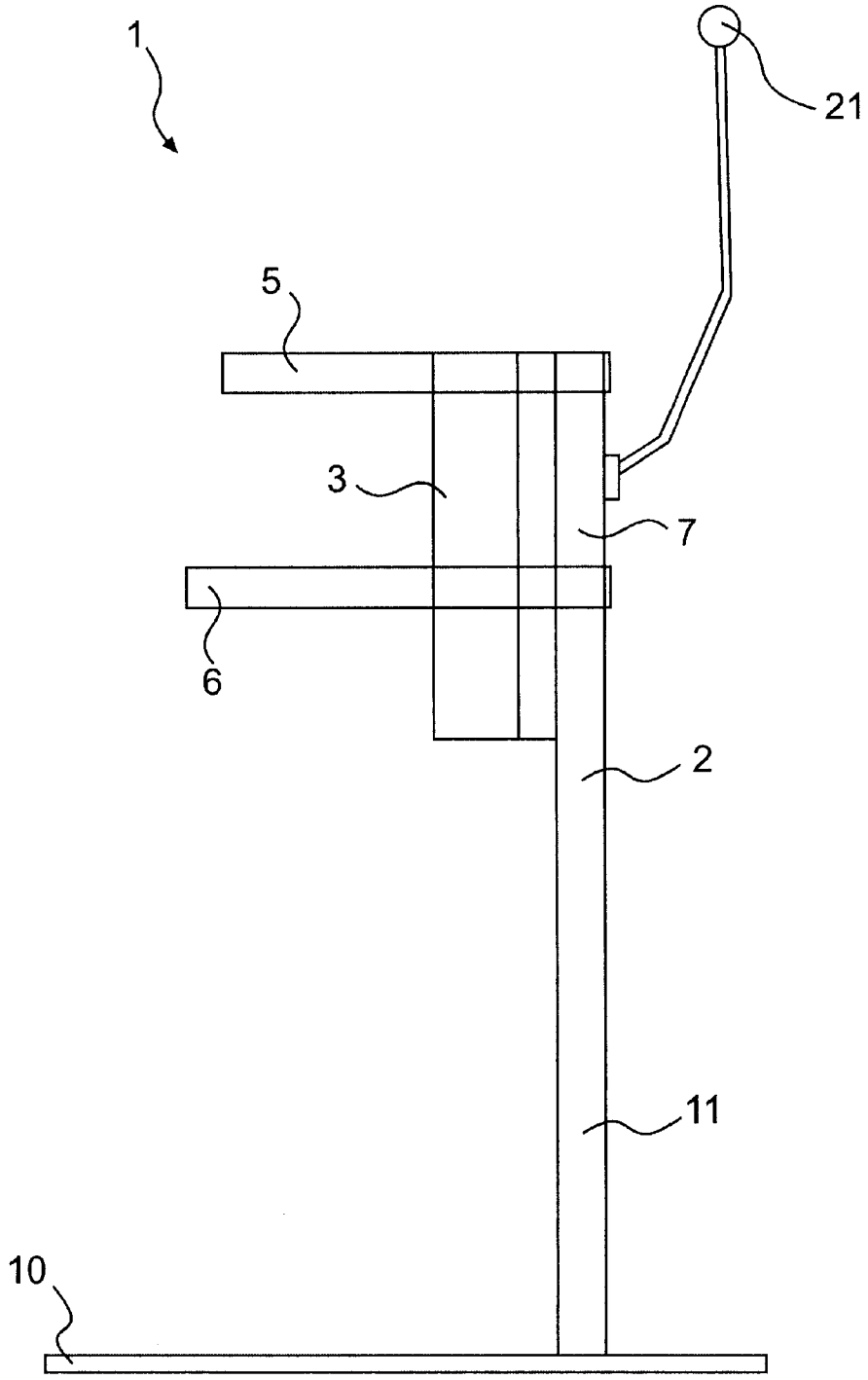
FIG. 2 is a side view of the device of FIG. 1.

FIGS. 1 and 2 illustrate a first example of a restraint and exercise device that provides such treatment for the lower back/pelvis/hip joint region of a human. The device 1 includes a support body 2, which defines at least one, and in this case two, support surfaces 3, 4, and a holder to clamp the pelvis of a user in a substantially fixed position against the support surfaces 3, 4. The holder may include one or more straps 5, 6 that extend around a user. As illustrated in FIG. 1, the straps 5, 6 are spaced apart and extend from a side wing 7 of the support body 2 and loop around to another side wing 8 of the support body 2. The straps 5, 6 are releasably attached to each side wing 7, 8 by means of, for example, clips or rope attachments. However, it will be appreciated that the straps 5, 6 may be integral with the support body 2 at one side wing, and may be releasably attached to the other side wing. Alternatively the straps 5, 6 may be integral with the support body 2 at both side wings 7, 8 with a release, such as a clip or rope, provided intermediate the ends of each strap 5, 6. In any event, any suitable attachment of the straps 5, 6 to the support body 2 may be employed.

The straps 5, 6 are adjustable in a number of ways. First, they may be moved up or down and positioned in any number of predetermined locations along side wings 7, 8. Side wings 7, 8 include a plurality of recesses 9 that are configured to receive clips on each end of the straps 5, 6 in a releasable manner. The inclination at which the straps 5, 6 extend from the side wings 7, 8 may also be adjusted by pivoting of the ends of the straps 5, 6 in the recesses 9. The clamping tension in the straps 5, 6 may be adjusted by means of, for example, a ratchet mechanism or a pulley system provided at some point along the straps 5, 6. In either case, it is preferred that the adjustment mechanism keep the straps under tension and permit the straps to be incrementally tightened without releasing the tension. An example of a suitable ratchet mechanism is described in conjunction with the discussion of other embodiments below.

The straps 5, 6 are preferably formed of a tough, flexible material, similar to or the same as the fibrous material from which conventional seat belts are made. Soft foam pads may be provided on the contact side of straps 5, 6 for enhanced comfort. Straps 5, 6 may have a high co-efficient of friction coating, such as a rubbery finish, to prevent slippage of the straps 5, 6 relative to the user's clothing and/or body.

Like straps 5 and 6, support surfaces 3, 4 may also be adjustable in a number of ways. Support surfaces 3, 4 in this embodiment are releasably attached to the support body 2 by means of, for example, hand-releasable screws or quick release mechanisms so that the support surfaces 3, 4 may be adjusted up or down in relation to body 2. An example of one suitable quick release mechanism is described below in connection with another embodiment. In this way, the height of each support surface 3, 4 is independently adjustable with respect to the other. The inclination of the support surfaces 3, 4 also may be adjusted (for example, with a hinge arrangement).

In one case, support surfaces 3, 4 at least partially include wedges or bolsters releasably attached to the support body 2 by means of hook and pile fastener material, such as Velcro. The wedges or bolsters may be selectively arranged on the support body 2 to ensure that the user is in a comfortable, pain free position clamped against the support surfaces 3, 4.

Support surfaces 3, 4 are preferably made of a resilient material, such as foam or rubber, to provide a sufficiently solid surface against which the user's pelvis is to be clamped. The support surfaces 3, 4 may be contoured to accommodate the shape of a pelvis, and differently shaped support surfaces may be provided to suit a range of anatomies.

Support body 2 may include a base 10 and a leg 11 extending from base 10. Support body 2 supports support surfaces 3, 4 and straps 5, 6 at a suitable height above ground level. More than one leg may be provided for additional support. The leg 11, which may be made of metal (for instance, steel), is rigidly connected to base 10. Base 10 is sufficiently wide to ensure that the device 1 is stable even when in a user is exercising on it. In this case, the base 10 is configured to define a platform on which the 'user stands when the user's pelvis is clamped against the support surfaces 3, 4. The user's body weight will thus further stabilize the device 1.

As described in more detail in conjunction with further embodiments discussed below, stool 12 may be provided on base 10 to provide a platform for exercising a leg of the user while the user's pelvis is clamped against the support surfaces 3, 4. The stool height may be adjusted.

A grippable bar 21 may be coupled to support body 2. As such, bar 21 is supported by support body 2. In the alternative, bar 21 could be supported by base 10, or by a separate supporting structure. The bar 21 may be gripped by the user and used to assist exercising of the user's back and/or leg while the user is clamped against support surfaces 3, 4. An elastic exercise band, or a pulley system may be attached to the bar 21 to assist user exercising. Again, an example of a suitable exercise band is described subsequently.

The support body 2 may be attached to a rigid supporting structure, such as a wall, a door, a floor, or an exercise machine (for example a weight machine). If so attached, base 10 may not be required. Any appropriate means may be used to attach the support body 2 to the rigid support structure. For instance, a recess could be provided in the side of the support body 2 opposite to the support surfaces 3, 4. The recess would mate with a corresponding protrusion, such as a hook, on the supporting structure. In the alternative, a conventional bracket or any other appropriate means could be used.

Figure 3:
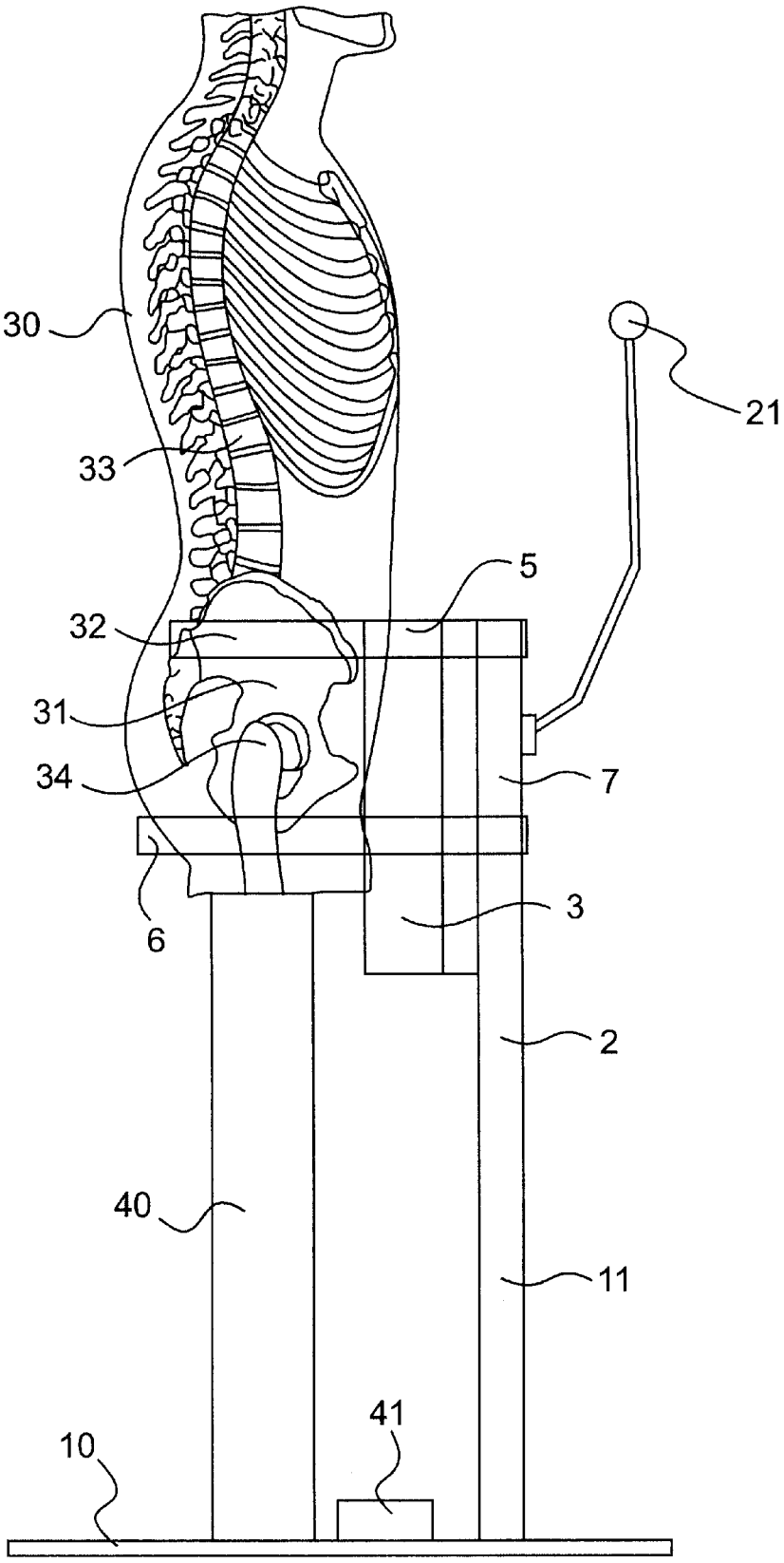
FIG. 3 is a side, partially cross-sectional view of the device of FIG. 1 in use.
Figure 5:
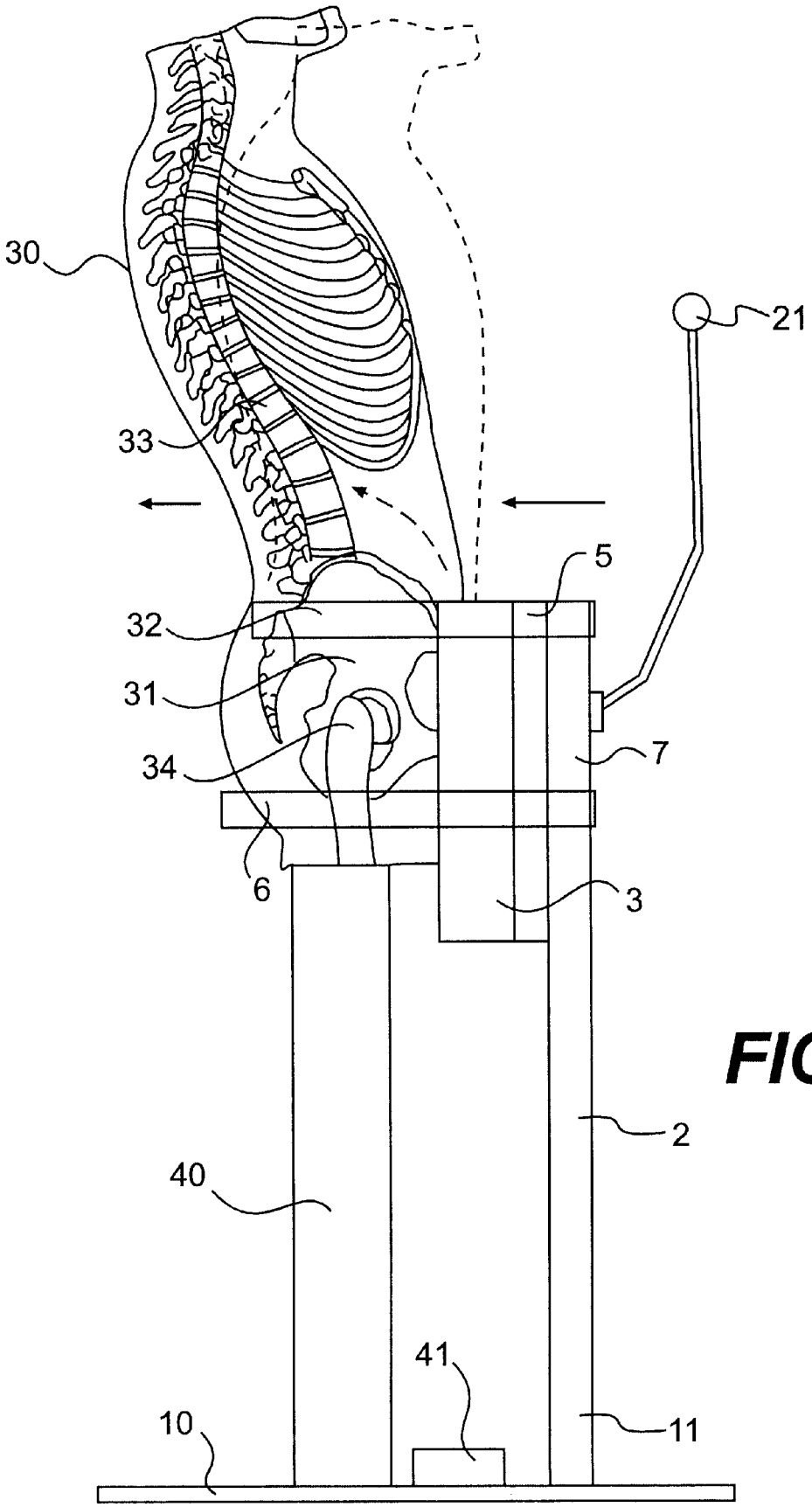
FIGS. 5 and 6 are side, partially cross-sectional views of the device of FIG. 1 in use.
Figure 6:
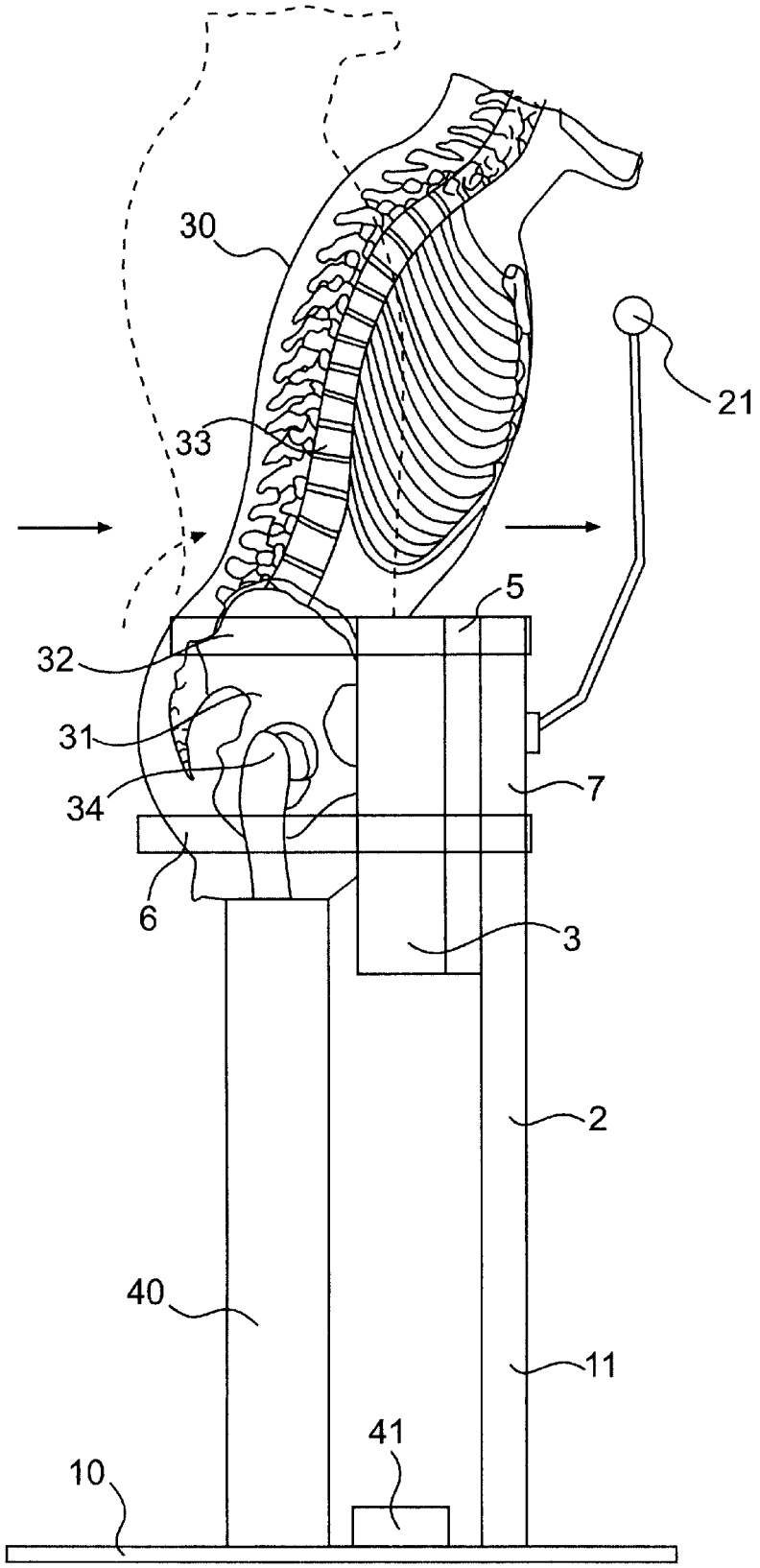

FIGS. 3, 5 and 6, illustrate a use of device 1. In this example, device 1 is used to exercise the lower back/pelvis/hip joint region of a human user 30. The legs 40 and feet 41 of the user 30 are represented schematically in FIGS. 3, 5 and 6 for convenience. In order to secure oneself to the device, the user (or an assistant) detaches one end of the straps 5, 6 from the side wings 7, 8. Alternatively, if the straps 5, 6 are integral with both side wings 7, 8, the release intermediate the ends of the straps 5, 6 is opened. In either case, the user 30 steps upon the base 10 and positions his/her pelvis 31 (e.g., front, rear, or sides) against the support surfaces 3, 4.

The support surfaces 3, 4 may be adjusted to suit the preferences and characteristics of the user 30. This is particularly advantageous if the support surfaces 3, 4 are contoured, as it is important that the user's pelvis 31 is aligned with the pre-formed contours to prevent discomfort. The adjustments are accomplished by moving the surfaces 3, 4 up, down, or at different inclinations. Support surfaces 3, 4 may be adjusted independently of one another. This enables the user 30 to achieve a comfortable position against the support surfaces 3, 4, despite any lack of symmetry in the pelvis 31 (as frequently occurs in the non-ideal anatomies of actual users).

When the user 30 is comfortably positioned with the pelvis 31 against the support surfaces, straps 5, 6 are looped around the user 30, and either reattached to the side wings 7, 8, or alternatively the release is closed. Typically, the straps are placed around the lumbopelvic region of the user. In other words, straps 5, 6 may be placed over the pelvic and/or lumbar regions. As with support surfaces 3, 4, straps 5, 6 each may be independently adjusted up, down, or at different inclinations. In addition, the clamping tension in straps 5, 6 may be adjusted, for example, by using a ratchet mechanism or pulley system, as noted above. Straps 5, 6 are so adjusted until the user's pelvis 31 is securely clamped against support surfaces 3, 4 in such a position that the user is substantially free of any pain or discomfort in the back. As described in more detail below, the adjustment features enable the pelvic region to move with six degrees of freedom and then be restrained in any of a number of three-dimensional positions, which substantially increases the likelihood of finding a pain-free position.

A typical clamped position is illustrated in FIG. 3. In this case, strap 6 extends from the side wing 7 around a lower part of the user's pelvis 31 to the other side wing 8, and strap 5 extends from the side wing 7 around a higher part of the user's pelvis 31 to the other side wing 8. It will be appreciated that the desired clamped position varies depending on the particular user. The straps 5, 6 may extend around the user at any point on the user's body as long as the user is securely clamped against the support surfaces 3, 4 in a pain-free position, as described above. Thus, the straps may be placed above or below the user's pelvis, or at any other anatomical area as determined by the user or assistant. The adjustability of the device in this manner provides flexibility enabling its use in any of a number of conditions and different body areas that can cause people pain, discomfort and/or decreased quality of movement.

Because the user is able to self-adjust the straps 5, 6 and support surfaces 3, 4, a pain free position may be readily achieved. Alternatively, another person, such as a supervising clinician, may assist in adjusting the straps 5, 6, and support surfaces 3, 4. When such a position has been achieved, the user 30 can then exercise his/her back or other body parts, often without assistance or intervention from another person, for example by bending backward (FIG. 5), and/or forward (FIG. 6). Thus, unlike manual mobilization techniques performed by a clinician, the invention enables the user to exercise using his/her own muscles. The straps 5, 6 and/or the support surfaces 3, 4 may be adjusted during the exercise session to ensure that the user is in a substantially pain-free position throughout the session. The bar 21 may be gripped by the user 30 to assist in exercising the back.

The exercises may be enhanced through the use of one or more elastic exercise bands attached to bar 21. An exercise weight stack pulley system also may be used to provide resistance to the exercises of the user. Bands and/or weights may be attached via a belt or harness to the user.

Figure 4:
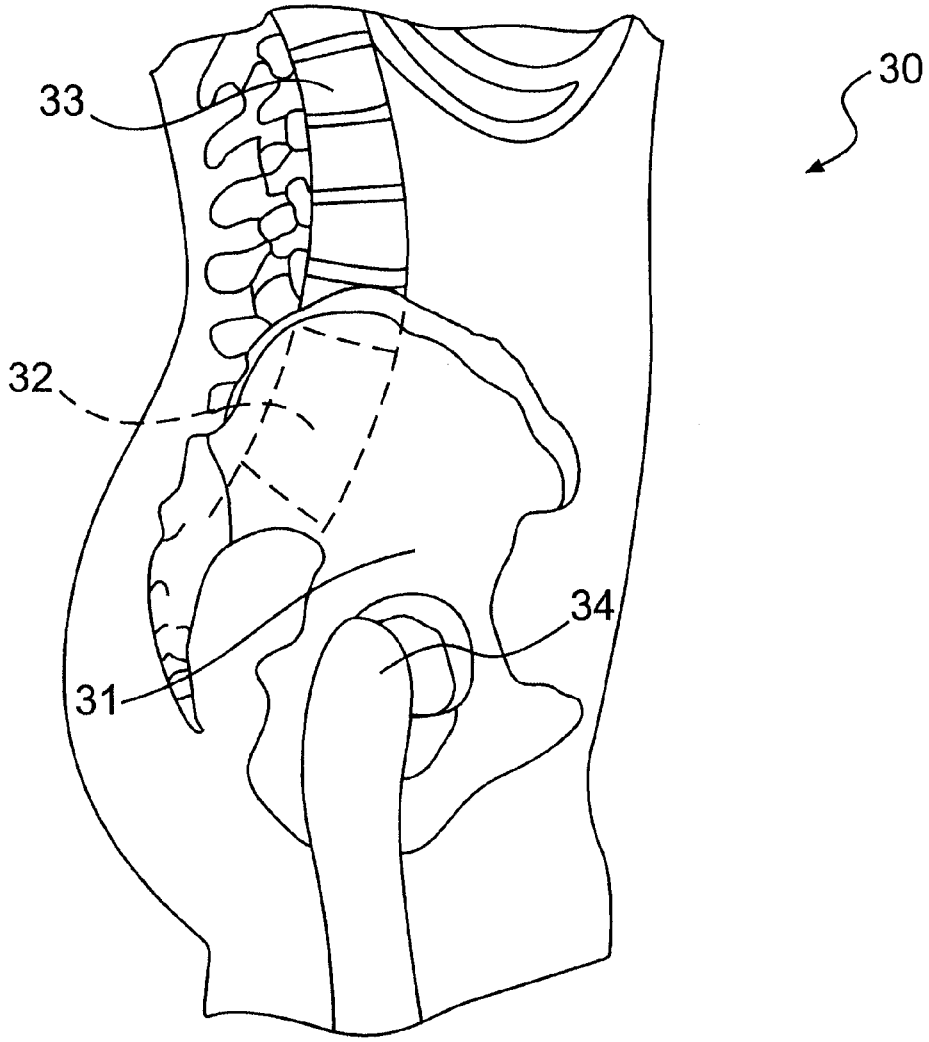
FIG. 4 is a side, partially cross-sectional view of the pelvis and lumbar spine region of a human.

The sacro-iliac joint 32 between the lumbar spine 33 and the pelvis 31 is illustrated in detail in FIG. 4. The sacro-iliac joint 32 is normally a relatively stiff or rigid joint, particularly in comparison to a relatively free-moving joint such as a hip-joint 34, or a shoulder-joint. Because the user's pelvis 31 is securely clamped against the support surfaces 3, 4 by straps 5, 6 during exercising of the back, substantially all movement of the user's back is translated into a pivoting of the user's spine 33 about the user's pelvis 31, which remains fixed (FIGS. 5 and 6). The pelvis clamping arrangement of the straps 5, 6 substantially prevents pivoting of the pelvis 31 about the hip joint 34 during the back exercise, as would normally occur if the pelvis 31 was unconstrained. By mobilizing the lumbar spine 33 to pivot about the pain-free positioned pelvis 31, the back exercise has a therapeutic effect on the user 30.

In a manner similar to that described for FIGS. 5 and 6, the user 30 can also perform leg exercises after being secured in a pain-free position. Because the user's pelvis 31 is securely clamped against the support surfaces 3, 4 by the straps 5, 6 during exercise, substantially all movement of the user's leg 40 is translated into a pivoting of the user's leg 40 about the user's pelvis 31, which remains fixed. The pelvis clamping arrangement of the straps 5, 6 substantially prevents pivoting of the pelvis 31 about the sacro-iliac joint 32 and lumbar spine 33 during the leg exercise, as would normally occur if the pelvis 31 were unconstrained. By mobilizing the leg 40 to pivot about the pain-free positioned pelvis 31, the exercise has a therapeutic effect on the user 30.

These exercises facilitate pivoting of the lumbar spine 33 about the pelvis 31, or pivoting of the leg 40 about the pelvis 31. It may also facilitate movement of some parts of the spine while restricting movements in other parts of the spine. This pivoting may help relocate any fault that may have developed in the pathological position of the lumbar spine 33 relative to the pelvis 31 at the sacro-iliac joint 32 and/or of the leg 40 relative to the pelvis 31 at the hip joint 34. By exercising with the pelvis 31 securely clamped in a pain-free position, the spine 33, and/or the pelvis 31, and/or the hip-joint 34 may become correctly re-aligned. The exercising may additionally or alternatively include twisting or rotational movements, stretching movements, flexing or extending movements, the lifting of exercise weights, sideways bending, or any other suitable exercise, as prescribed for the user 30 by a clinician, for example. It is believed that having the user use his/her own muscles to perform the exercises in a pain-reduced environment may induce certain beneficial neurological and/or muscular responses, not possible with manual mobilization techniques, that facilitate healing and/or pain reduction.

After exercising the straps 5, 6 are detached (or the release means along the straps 5, 6 is opened) and the user 30 then steps away from the support surfaces 3, 4 and off the base 10. It has been found that after such an exercise session, the reduced pain feeling or substantially pain-free feeling experienced by the user while clamped to the support surfaces 3, 4 persists.

Figure 7:
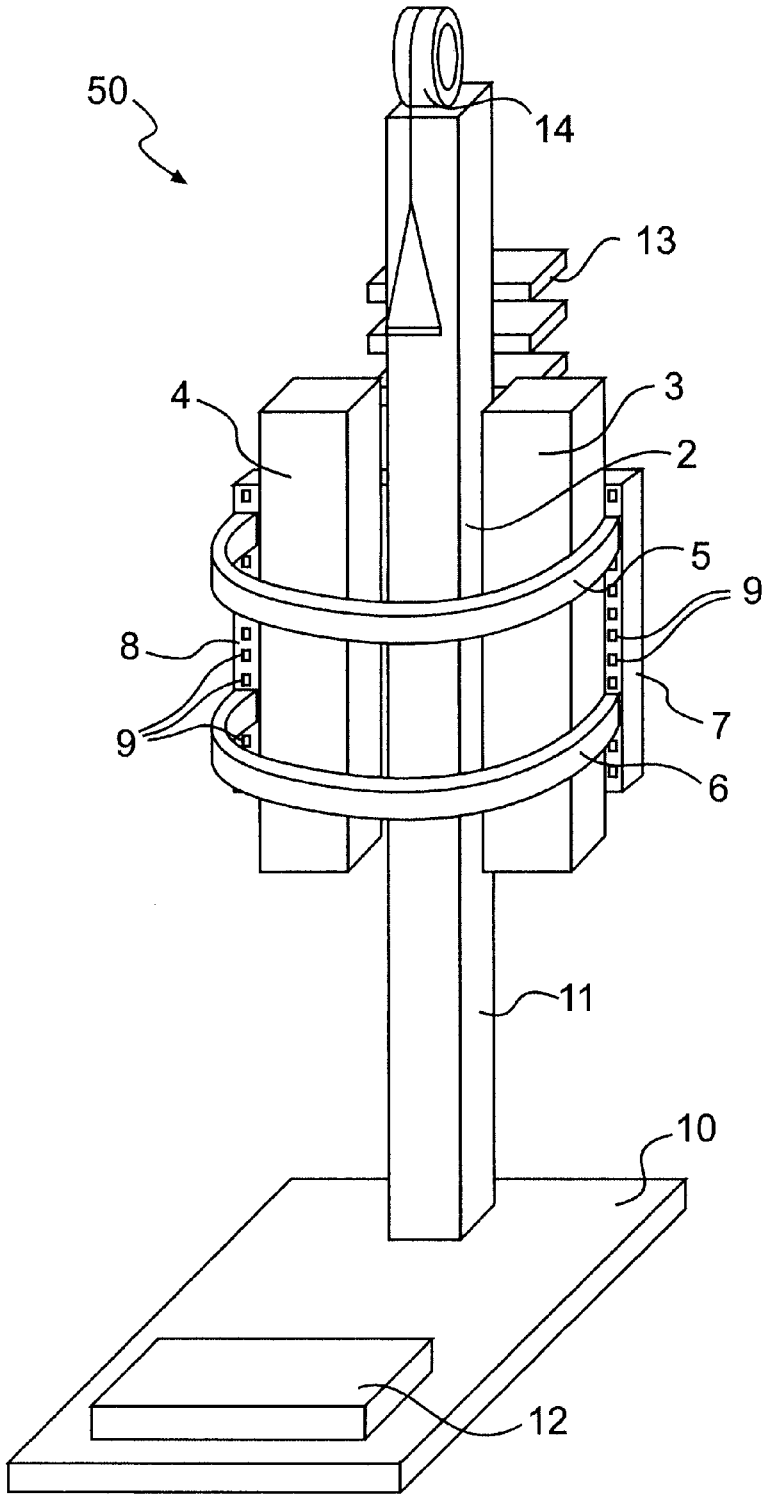
FIG. 7 is a perspective view of a second embodiment of a lumbopelvic restraining and exercise device constructed according to the principles of the invention.

Referring now to FIG. 7, there is illustrated a second example of a pelvic restraint and exercise device 50 constructed according to the invention. The device of FIG. 7 is similar to the device 1 of FIGS. 1 to 6, and similar elements in FIG. 7 are assigned the same reference numerals. In this case, exercise weights 13 are provided in place of the grippable bar 21. The exercise weights 13 are provided on the support body 2, and are attached to a pulley mechanism 14. The weights 13 are supported by the support body 2, and may be used by the user to assist in exercising the user's back and/or the user's leg 40 after the user has been clamped against the support surfaces 3, 4.

Figure 8:
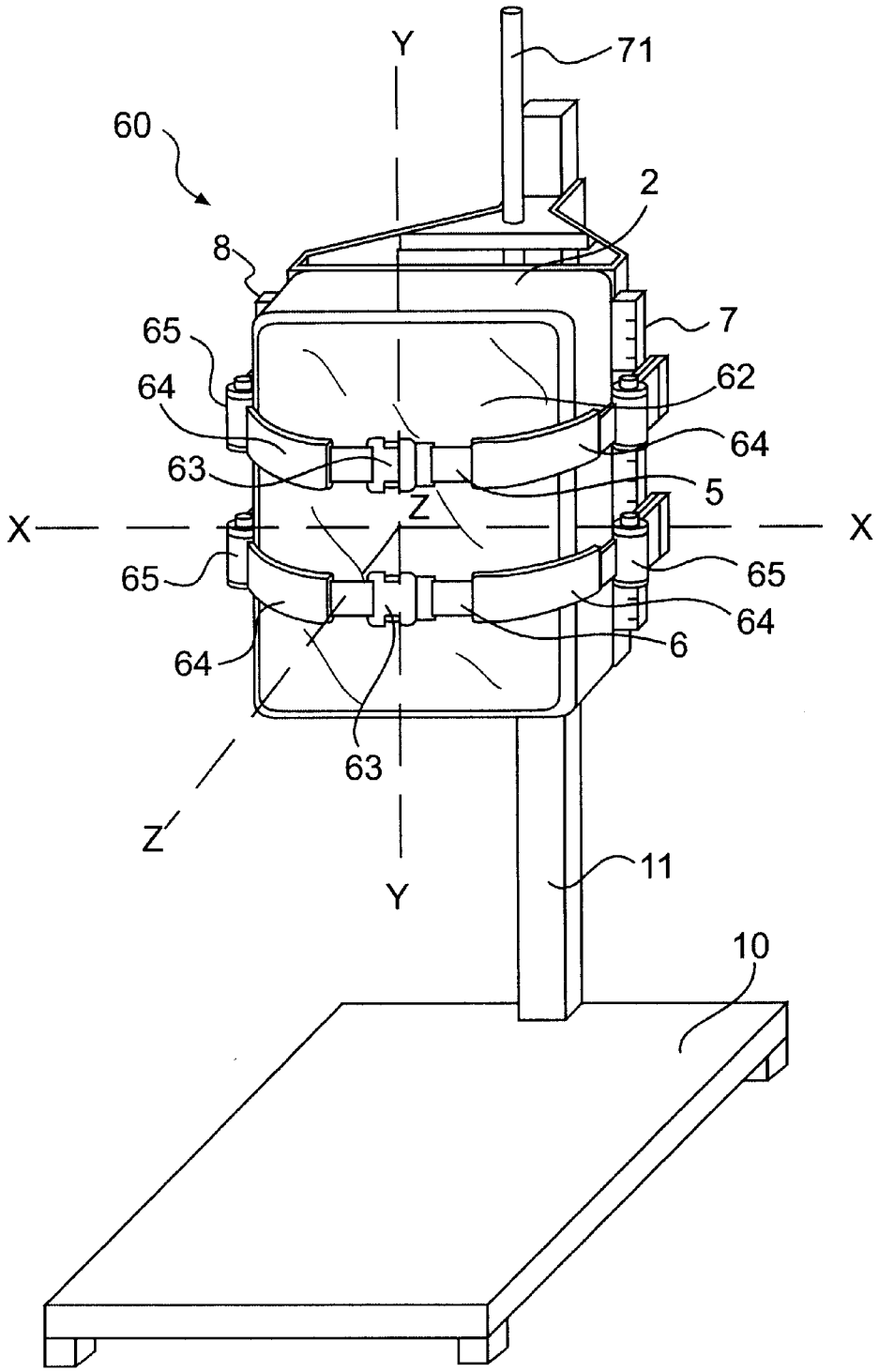
FIG. 8 is a perspective view of a third embodiment of a lumbopelvic restraining and exercise device constructed according to the principles of the invention.
Figure 11:
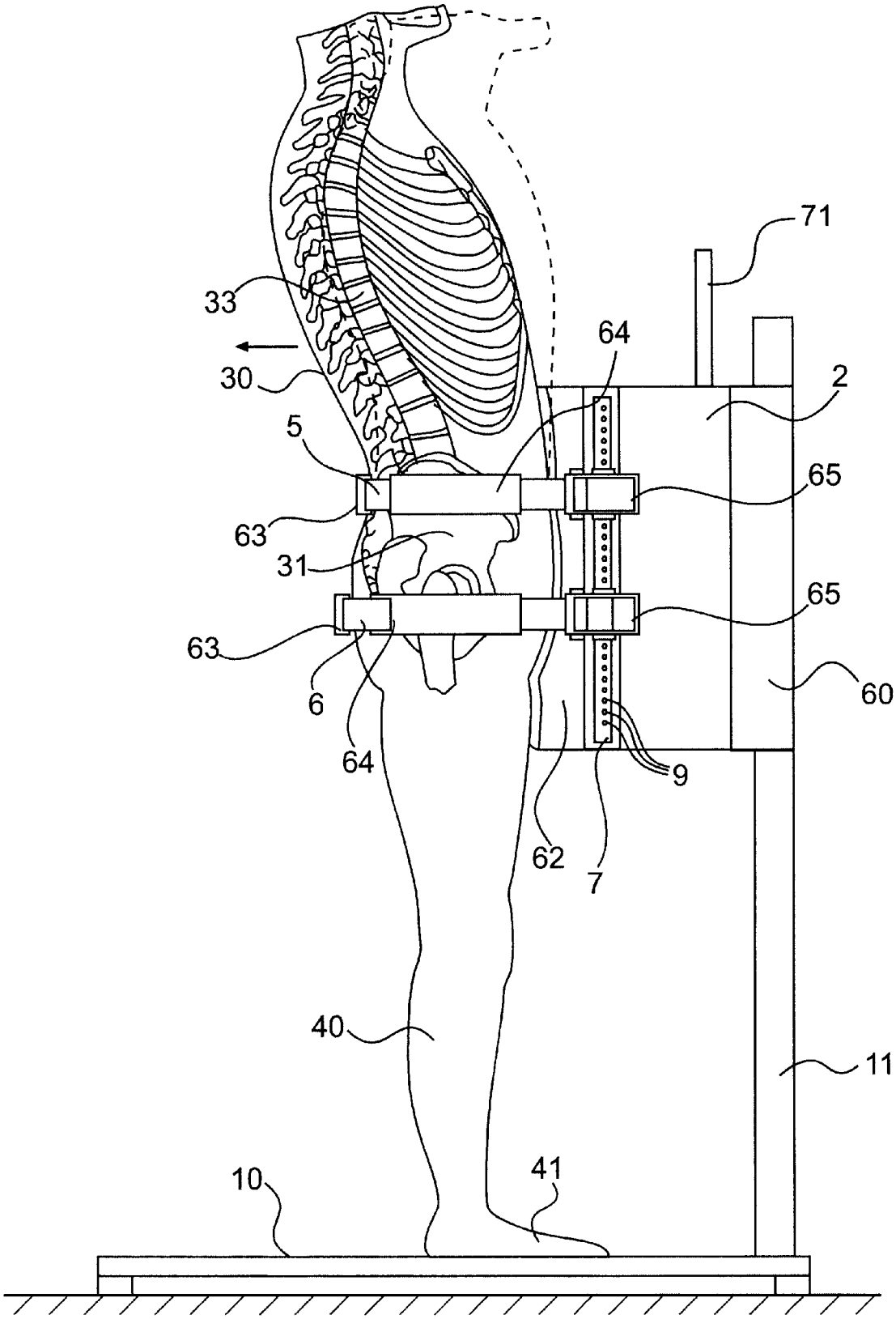
Figure 11A:
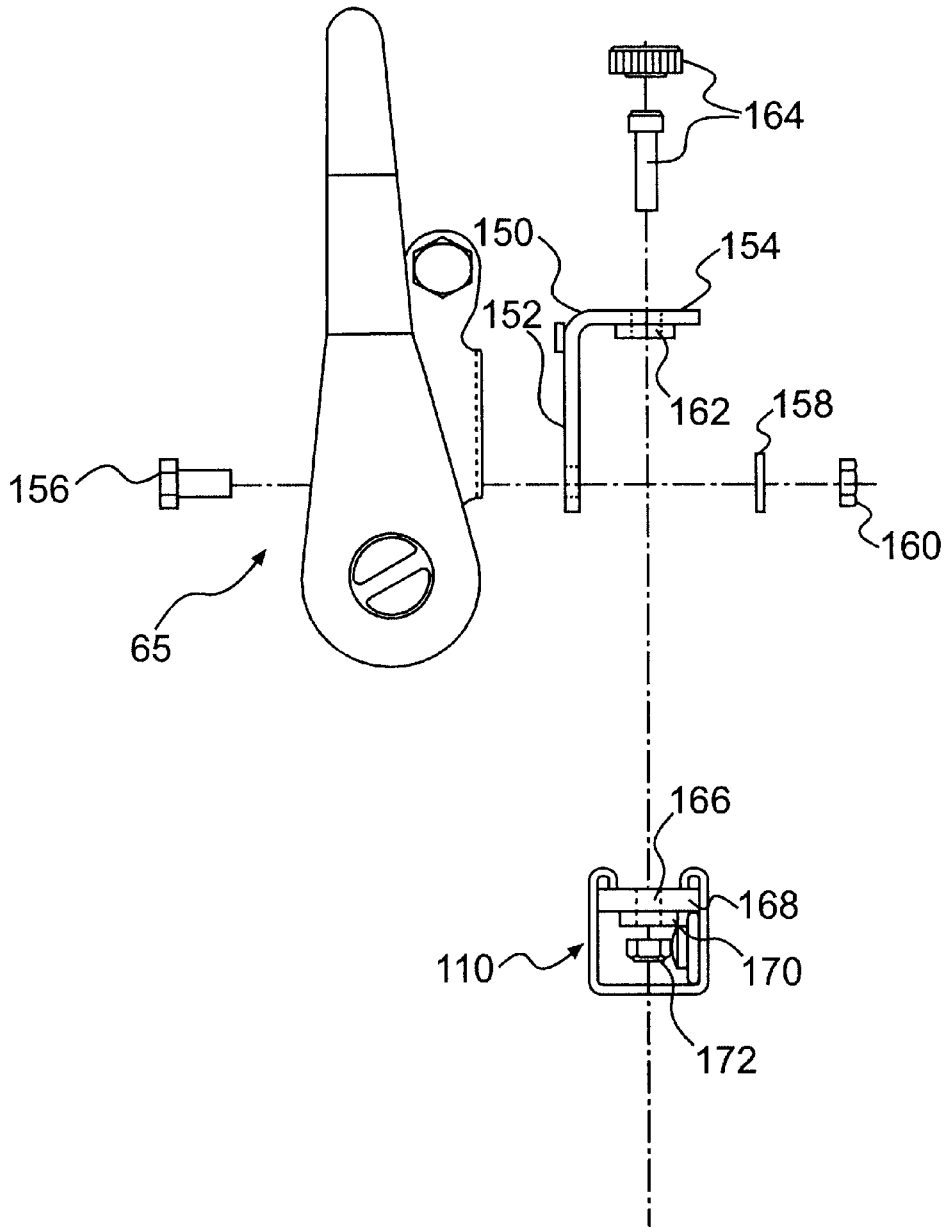
FIG. 11A is an exploded view of a ratchet and unitrack assembly that may be used to adjust the tension and height of the holding straps of the invention.
Figure 11B:
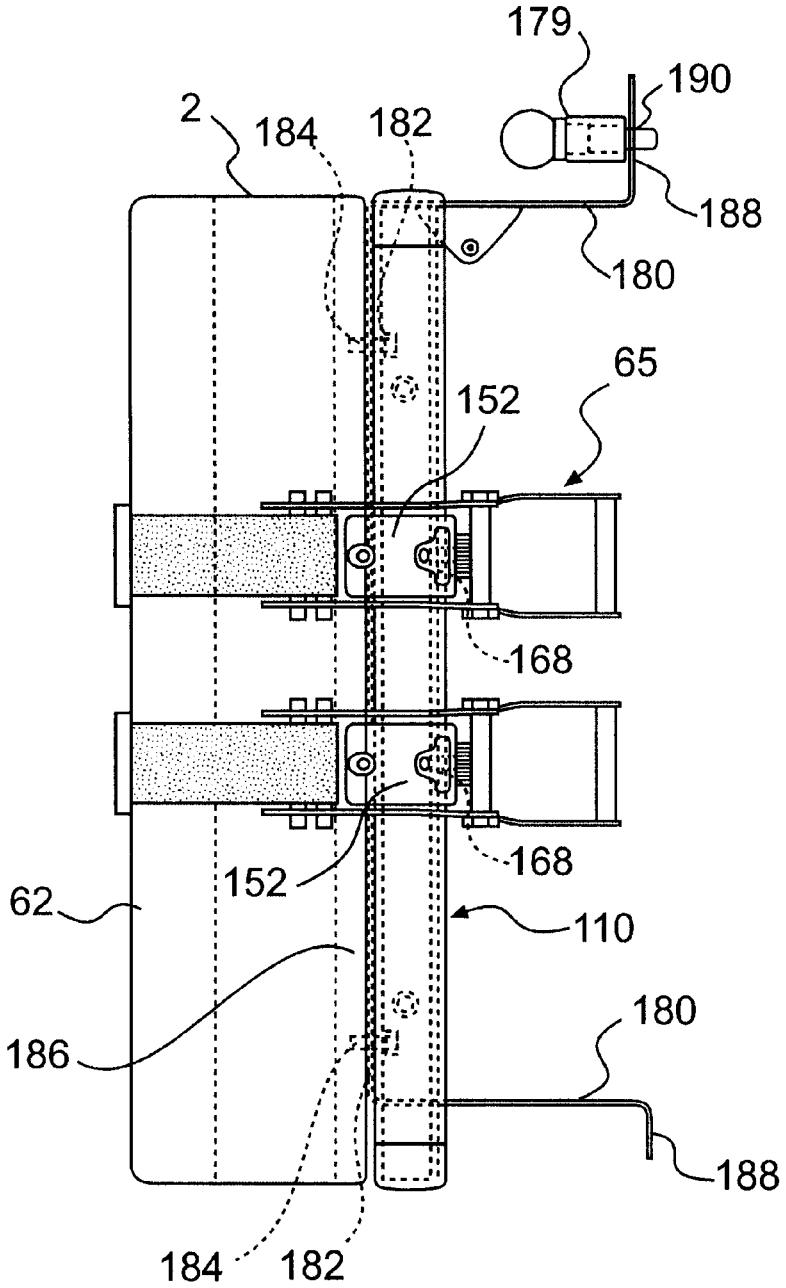
FIG. 11B is a side view of a support body and carriage member that may be used with the ratchet mechanism of FIG. 11A, according to the principles of the invention.

FIGS. 8 to 11 illustrate a third example of a pelvic restraint and exercise device 60 constructed according to the invention, which is similar to device 1 of FIGS. 1 to 6. Identical reference numerals are assigned to elements in FIGS. 8–11 that are similar to corresponding elements in FIGS. 1–6. Device 60 includes a support body 2 defining a single support surface. Support body 2 includes, in this case, a padded bolster 62. The padded bolster can include a plywood backing (such as shown in FIG. 11B at 186) covered with high density polyurethane foam, which in turn is covered with low density polyurethane foam. A vinyl covering covers the foams. Other suitable padding and covering materials may be employed. The bolster 62 is fixed to the support body 2, and may be sufficiently wide to extend across the entire width of the user's pelvis 31. In FIG. 8, bolster 62 is a relatively flat pad. However, the bolster could be shaped or angled to conform to the user or to provide pressure points. As discussed above, wedges could also be coupled to bolster 62 to provide the same effect. Extensions could also be added above, below, or to the sides of bolster 62. The extensions could be hinged to bolster 62 so that they can be angled towards or away from the user. The angle of inclination of the support body and/or the bolster 62 may be adjusted by any suitable mechanism. In addition, bolsters or wedges may be placed between the restraining belts 64 and the user of the device and/or under one or both feet. The bolsters and wedges may be employed to create an angulation of the pelvis or spine, which may be useful in locating a pain-free position.

Figure 8A:
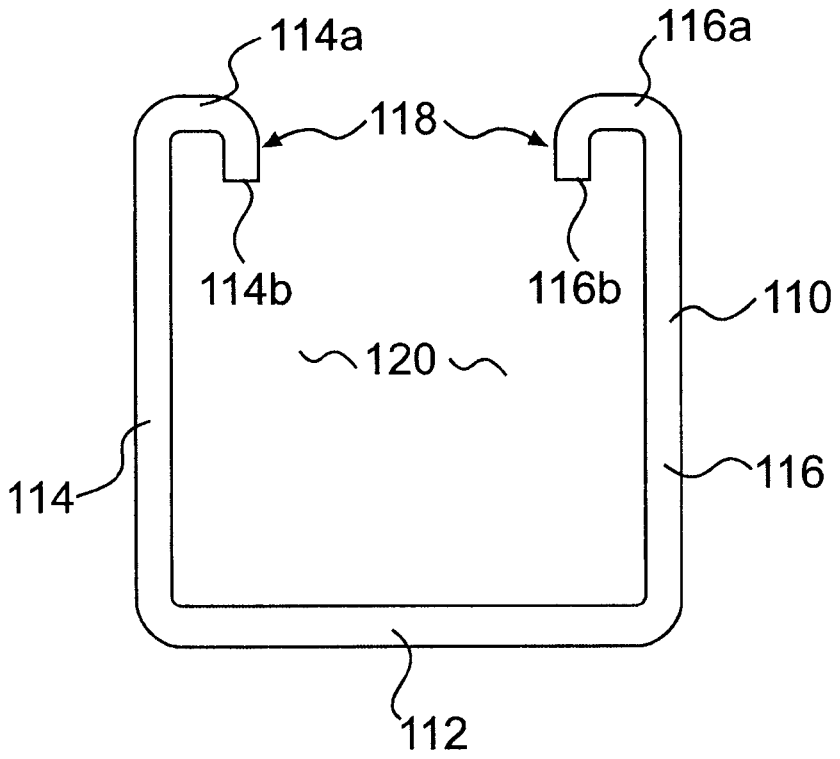
FIG. 8A is a plan view of a unitrack member that may be used to support the support pad and the ratchet mechanism of the invention.
Figure 11C:
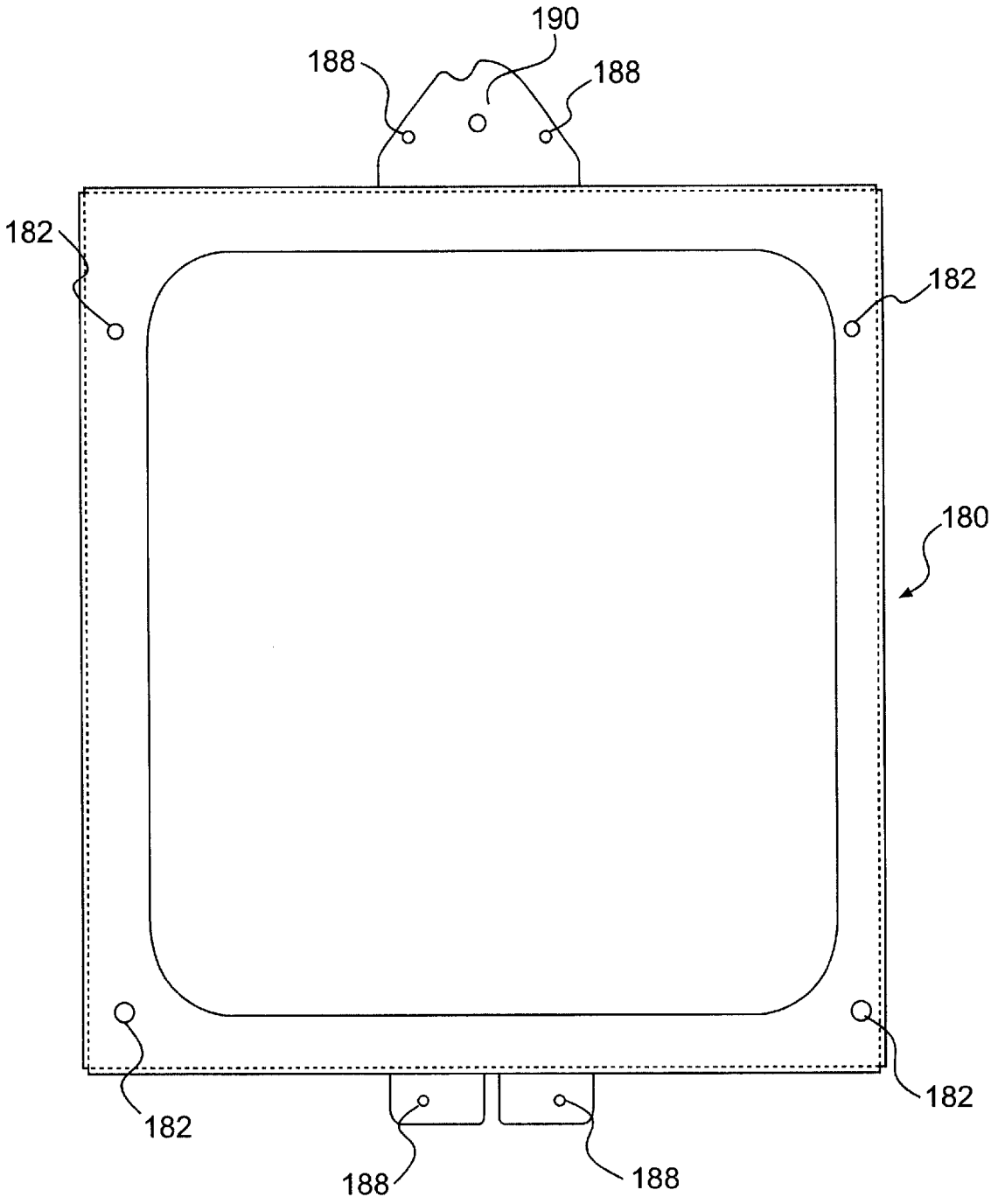
FIG. 11C is a plan view of the carriage member of FIG. 11B.

Support body 2 is supported by leg 11. As shown in FIG. 8, support body 2 is fixedly secured to leg 11. It could be integrally formed with leg 11. However, support body 2 preferably should be movable up and down in order to adjust to the height of the user. This could be accomplished in many ways. For instance, support body 2 could include a carriage plate slidably mounted on leg 11. FIGS. 11B–11C illustrate a suitable carriage plate 180 having holes 182 for fixedly securing the carriage plate to the back of the plywood backing 186 of padded bolster 62. Referring to FIG. 11B, screws 184 or other fasteners may be inserted through holes 182 and screwed into plywood backing 186. Carriage plate 180 may then be slidably mounted on leg 11 as described below. Leg 11 could include or be formed from one, two, or more unitracks, i.e., a member having an elongated recess. An example of a suitable unitrack from which leg 11 may be formed is illustrated in FIG. 8A as a generally "C"-shaped channel section 110, which may be constructed from galvanized steel or other suitable material. Channel section 110 is defined by longitudinally extending back 112 and opposed side portions 114, 116, which curve inwardly at 114*a*, 116*a* to define an opening 118 into the interior of channel section 110. The inner surfaces of back and side portions 112 and 114, 116 bound the interior of the channel, which defines an elongated recess 120.

Figure 8B:
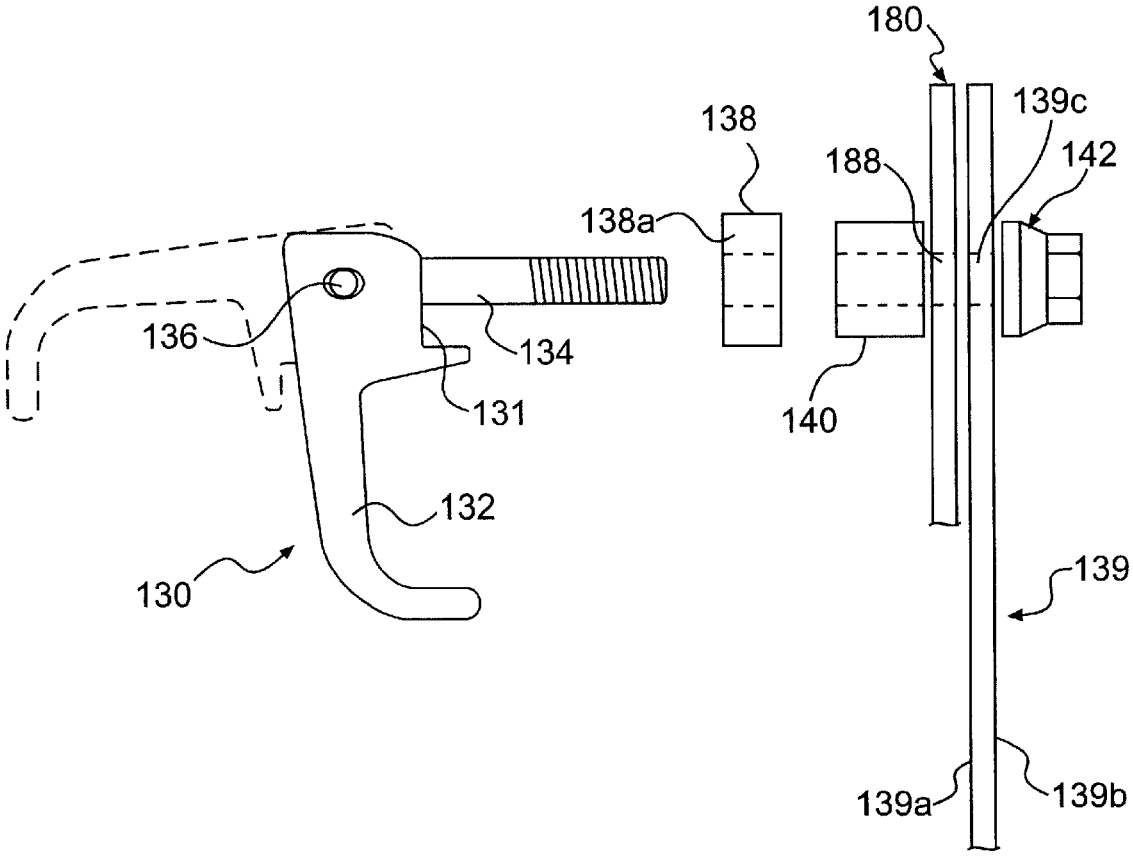
FIG. 8B is an exploded, side view of a quick release mechanism that may be used with a unitrack member of the invention.
Figure 8C:
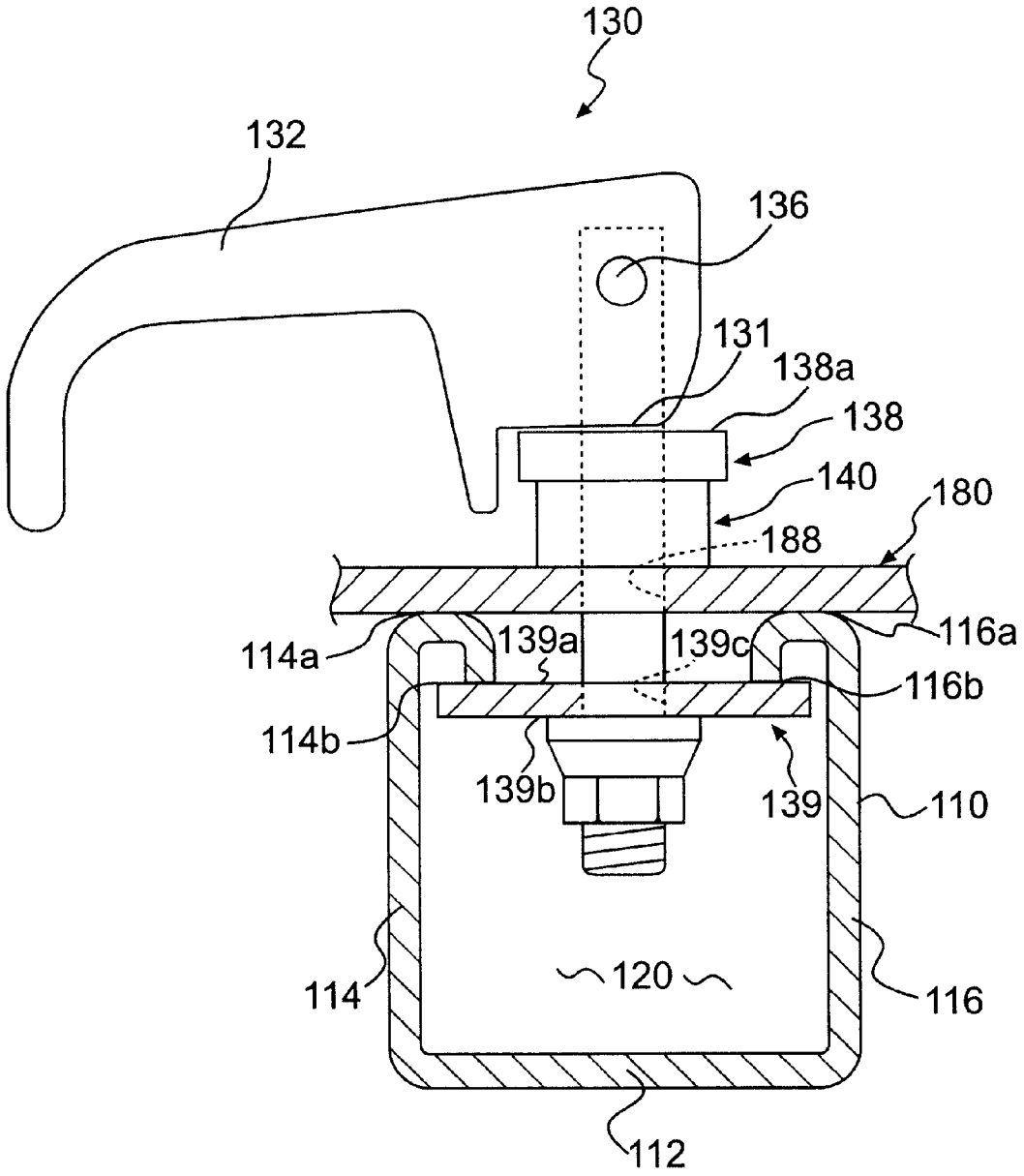
FIG. 8C is a partially cross-sectional view illustrating the quick release mechanism of FIG. 8B engaged with the unitrack member of FIG. 8A.

One or more portions of support body 2 may project into and be slidably retained within the recess 120, thus allowing support body 2 to move up and down along the track. One or more of the projecting portions could include a quick release mechanism, similar to the quick releases used on bicycles to mount the wheels to the frame. The release acts as a latch to lock the support body 2 into place at a desired height. When the release is unlocked, the support body 2 is able to move up and down. An example of a suitable quick release mechanism 130 is shown in FIGS. 8B–8C. However, any suitable release may be used. Quick release mechanism 130 includes a handle 132 pivotally connected to a threaded shaft 134 by a pin 136. A washer 138 and resilient bushing 140, such as a rubber bushing, may be placed over the free end of shaft 134. Shaft 134 may then be inserted through a hole 188 in carriage plate 180 for slidably mounting the carriage plate to a unitrack. Plate member 139 may be placed over the free end of shaft 134 and retained in place by a suitable nut 142. In use with a unitrack such as shown in FIG. 8C, washer 138, bushing 140, carriage plate 180, plate member 139, and nut 142 are connected so as to be able to slidably engage the unitrack. More particularly, plate member 139 may be in the form of an elongated rectangular plate made from polyethylene, steel, or other suitable material having opposed surfaces 139*a* and 139*b*. Plate member 139 may extend lengthwise along the height of the carriage plate, e.g. from top hole 188 to bottom hole 188 in FIG. 11C. As shown best in FIG. 8C, washer 138, bushing 140, and carriage plate 180 are disposed outside the unitrack 110 trapped between outwardly facing surfaces 114*a*, 116*a* of the unitrack 110, and a face 131 of handle 132, which acts as a camming surface as described below. The plate member 139 and nut 142 are positioned within the recess 120 of the unitrack 110 such that the surface 139*a* abuts against the inwardly facing surfaces 114*b*, 116*b* of the unitrack's side channel portions 114, 116. Referring to FIGS. 8B–8C, as the shaft 134 and nut 142 are tightened, inner surface 139*a* of plate member 139 becomes seated against the unitrack's inner channel surfaces 114*b*, 116*b*, the carriage plate 180 becomes seated against the unitrack's curved portions 114*a*, 116*a*, washer 138 seats against resilient bushing 140, and the resistance to sliding movement between the carriage plate and unitrack becomes greater. Handle 132 may be pivoted to the position shown in solid lines in FIG. 8B to trap washer 138 tightly between camming surface 131 of handle 132 and the bushing 140, which compresses bushing 140 tightly between washer 138 and carriage plate 180 to lock the mechanism in place, thereby preventing sliding movement between the unitrack and the support body 2. Pivoting the handle 132 to the dashed lines shown in FIG. 8B releases the mechanism to facilitate sliding. In one advantageous design, the leg 11 includes two unitracks, each of which may have two quick releases that cooperate with respective holes in the carriage plate. Plate member 139 may be formed with upper and lower holes 139*c* to accommodate two quick release mechanisms within one unitrack. The unitrack and quick release mechanisms preferably would be located at the front of leg 11 (facing support body 2) and above and below support body 2 to facilitate user-adjustment, such as at 188 of carriage plate 180 as shown in FIG. 11B.

A detent mechanism 179 also shown in FIG. 11B may support carriage plate 180 at a selected height along leg 11 while a user tightens or loosens the quick release mechanisms. Detent mechanism 179 may be a springloaded pin as is well-known in the art, and may be insertable through hole 190 of carriage plate 180 and into one of a vertical series of holes formed in leg 11 to prevent relative movement between the leg 11 and support body 2. A damping cylinder may be associated with leg 11 (e.g., located around, connected to, etc.) and attached to the bottom of support body 2 to facilitate the lifting of support body 2 and prevent the support body from falling too quickly upon release of the release mechanism and/or the detent mechanism 179. In another example, leg 11 may itself be a damping cylinder, and support body 2 may be fixedly secured to leg 11. As a result, support body 2 moves with leg 11.

As with FIGS. 1–7, device 60 of FIG. 8 includes a holder for securing a person to support body 2. The holder includes two straps 5, 6 for extending around a user, yet more than two straps might be utilized. The ends of each strap 5, 6 may be releasably attached to each side wing 7, 8 by a ratchet mechanism 65 designed to adjust the tension of the belts in small increments without releasing the tension. An example of a suitable ratchet is shown in more detail in FIG. 11A, and commercially available from A-Belt-Lin Industrial and Trading Co., Ltd., www.abeltc.com, vendor item code TDB-502. Of course other devices may be used to adjust the tension of the holding straps, such as electrically driven stepper motors or the like suitable for adjusting belt length.

Figure 9:
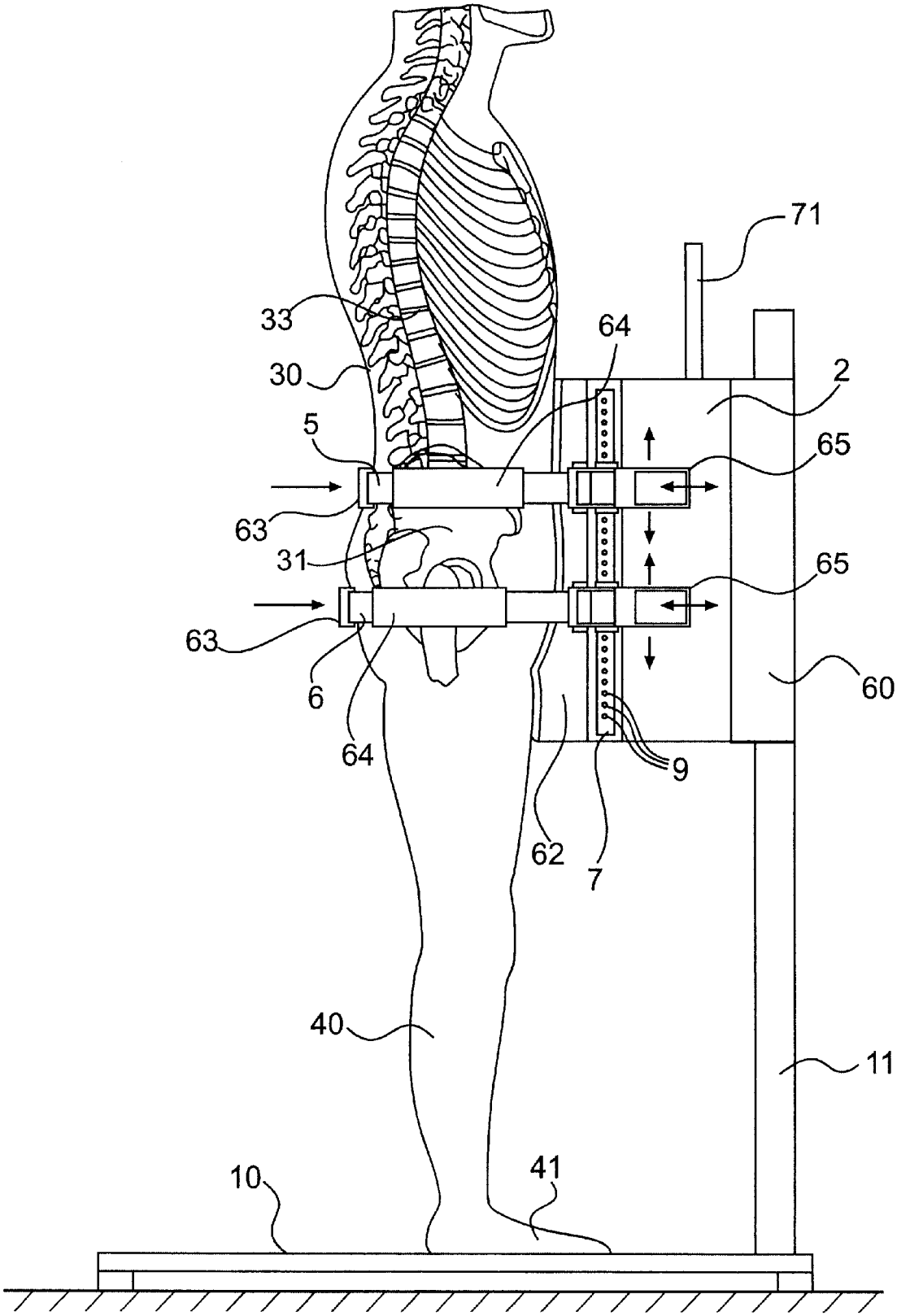
FIGS. 9 to 11 are side, partially cross-sectional views of the device of FIG. 8 in use.
Figure 10:
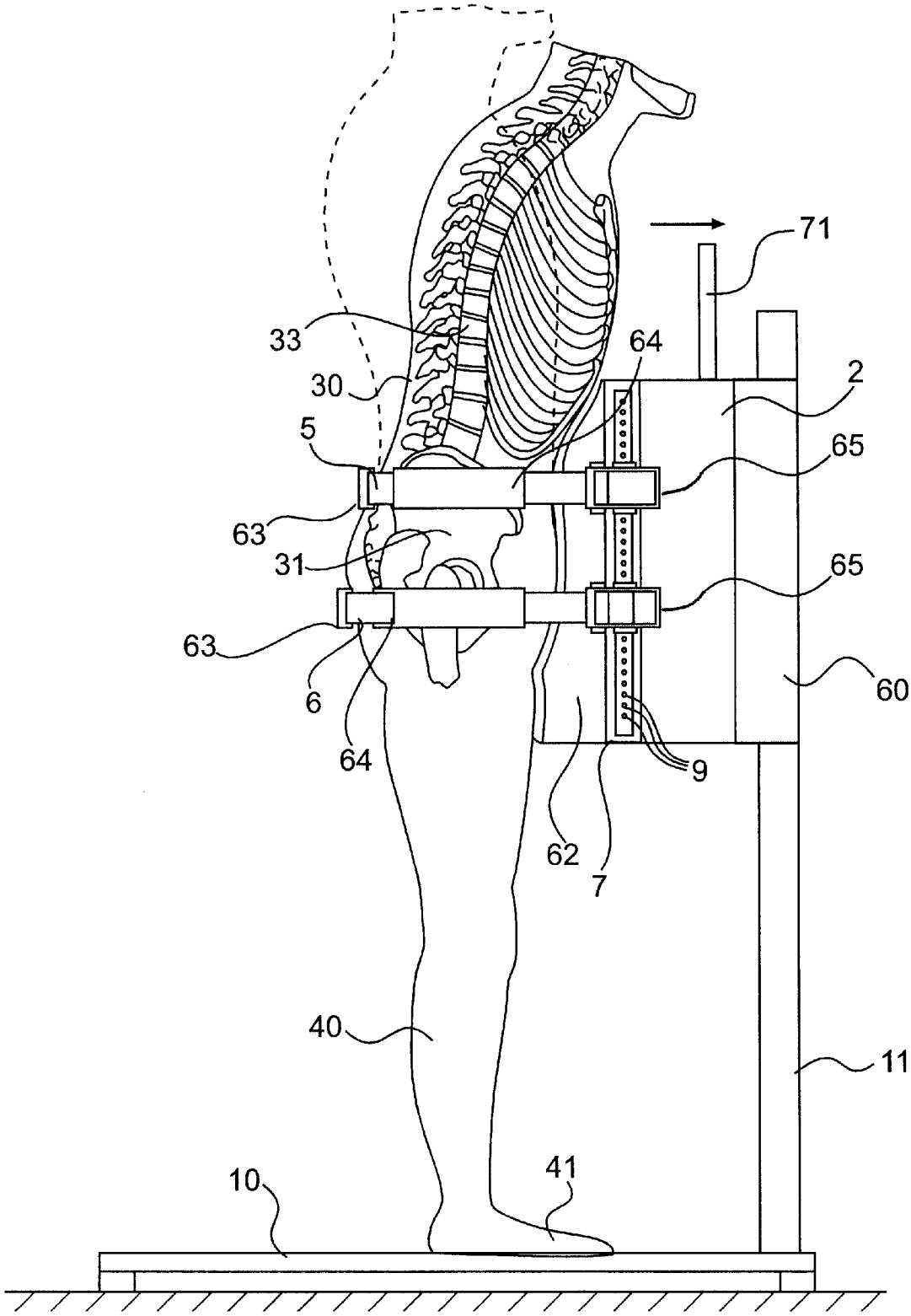

As illustrated in FIG. 9, a plurality of recesses 9 are provided spaced along each side wing 7, 8. The ratchets 65 may be attached to the side wings 7, 8 by extending a fixing pin through each ratchet 65 into a co-operating recess 9 in the side wing 7, 8. This enables the location of the ratchets 65 to be adjusted up or down along the side wings 7, 8, and accordingly the position at which the straps 5, 6 extend around the user 30 may be adjusted to suit a user. Other types of strap position adjustment devices may be employed instead of the recess and pin arrangement. For example, instead of providing the side wings, 7, 8 with recesses, they may be formed from or include a unitrack mechanism having a cross sectional shape like channel 120 illustrated in FIG. 8A. Each ratchet mechanism may include structure projecting into and captured within the recess of the unitrack's channel to support the ratchet mechanism for sliding movement up and down the length of the unitrack. One such suitable arrangement is illustrated in FIGS. 11A–B.

Ratchet mechanism 65 may be secured to a mounting bracket 150. Bracket 150 may be in the form of an angle bracket having L-shaped portions 152, 154. Ratchet mechanism 65 may be secured to L-shaped portion 152 by bolt 156, washer 158, and nut 160. L-shaped portion 154 may include a thru-hole 162. A bolt assembly 164 passes through hole 162, and further through a hole 166 formed in a rectangular washer 168 and through bushing 170, both of which are situated within the unitrack's recess 120. In this manner, nut 172 may be loosely tightened on bolt assembly 164 to retain ratchet mechanism 65 in a predetermined position relative to the unitrack's channel section 110. Washer 168 preferably may be made of polyethylene and frictionally engages inner channel surfaces 114*b*, 116*b* when nut 172 is tightened on bolt assembly 164. In another embodiment, bushing 170 and nut 172 may be replaced by a rectangular steel nut formed of dimensions similar to washer 168, and having threads to engage bolt assembly 164. Accordingly, ratchet mechanism 65 may slide vertically up or down the unitrack's channel section 110, and be frictionally held in place with respect to the unitrack, thus assisting a user to achieve a pain-free position as previously described. Nut 172 may be loosely tightened on bolt assembly 164 to provide sufficient play such that the weight of ratchet mechanism 65 causes leg 154 to tilt off of a vertical axis. L-shaped portion 154 may then impart a tension force in bolt assembly 164 which in turn pulls washer 168 in friction contact with the unitrack's channel surfaces 114*b*, 116*b* sufficient to hold the ratchet mechanism and attached straps in place. FIG. 11B illustrates two ratchet mechanisms 65 vertically spaced apart along a unitrack's channel section 110, similar to FIG. 9.

The ratchets 65 enable the clamping tension in the straps 5, 6 to be selectively adjusted by the user 30, or by another person (such as a supervising clinician), to ensure that the pelvis 31 of the user 30 is clamped against the bolster 62 in a substantially pain-free position before exercising. It is preferable that each ratchet be able to make fine adjustments of approximately 12–13 millimeter precision or less. Precision to less than about 12–13 millimeters, including to a fraction of a millimeter, while not required may be achieved by any means known in the art such as stepper motors mentioned above and provides even greater ability to achieve a substantially pain-free position. However, each ratchet could, of course, have courser adjustments than a fraction of a millimeter—for example, approximately two millimeter precision or less, three millimeter precision or less, four millimeter precision or less, five millimeter precision or less, or greater depending upon the application and desired adaptability of the device. As noted above, rather than using ratchets 65, electronic or other adjustors having the same fine adjustment capability may be employed. As a result, each strap 5, 6 has at least two independently adjustable leverage points.

Each strap 5, 6 has a buckle 63 intermediate the ends of the straps 5, 6, as illustrated in FIG. 8. The buckles 63 enable the straps 5, 6 to be quickly and easily opened to release the clamping of the user's pelvis 31 against the bolster 62. The straps 5, 6 preferably are made of a suitable strong, durable material, such as the material of conventional airline or automobile seat belts. Soft pads 64 or wedges may be provided along the straps 5, 6 to prevent discomfort to the user 30 when the straps 5, 6 are securely clamped around the user 30.

Device 60 is used similarly to devices 1 and 50 shown in FIGS. 1–7. The user 30 opens the buckles 63 and steps upon the base 10 and positions his/her pelvis 31 (back, front, or side) against the bolster 62. The straps 5, 6 are extended around the user's pelvis 31 and the buckles 63 are closed. The user 30 can then adjust the position of the straps 5, 6 by adjusting the location of the ratchets 65 along the side wings 7, 8, and can adjust the clamping tension in the straps 5, 6 by means of the ratchets 65 (FIG. 9).

The ratchets 65 act as leverage points for the straps. In this case the leverage points are located on either side of the user. Adjusting the clamping tension in either side of each strap rotates the pelvic area width-wise along the user's body, i.e. about a generally vertical axis, such as y—y shown in FIG. 8. A different rotational motion of the pelvis is caused by adjusting the location of the ratchets along side wings 7, 8, in combination with adjustments to the tensions of straps 5 and 6. Changes to the difference in tension between straps 5 and 6 causes the pelvis to rotate length-wise along the user's body, i.e. about a generally horizontal axis such as x—x shown in FIG. 8. Moreover, the user may rotate his pelvis about an axis perpendicular to the front surface of the bolster 62, such as z—z shown in FIG. 8 by raising or lowering one leg and then tensioning the straps to hold this position. The user may stand on a bolster, wedge or other support to facilitate positioning in the desired orientation. Using all of ratchets 65 in combination helps the user to reposition the pelvic area until reaching a substantially pain-free position. Preferably, the ratchets are tightened or loosened one at a time until a substantially (or completely) pain-free position is found. This ensures that the subsequent exercises have a maximum therapeutic effect on the user 30.

In this example, the adjustments help the user reach a substantially pain-free position by permitting the pelvic region to move in six degrees of freedom—they provide for three-dimensional adjustment capability. These adjustments can be accomplished incrementally while the user is completely or at least partially secured against bolster 62 by straps 5, 6. Hence, the user can reposition himself or herself even after securing the pelvis. Once a pain-relieving position is found, all of the ratchets 65 are tightened evenly to maintain the substantially pain-free position and prevent the pelvic region from returning to a more painful position.

One or more of these actions can be performed by the user or by another person, such as a clinician. The user 30 then performs exercises, such as exercising the back 33 by bending forward (FIG. 10) or backward (FIG. 11), or any other suitable exercise, such as those described previously with reference to FIGS. 1 to 7.

The mobility of support body 2 leads to other possible uses of the invention. Once the user's pelvis 31 is securely clamped against bolster 62, the movable support device 2 could be released and allowed to move up and down along with the user.

To release the clamping of the pelvis 31 to the bolster 62, buckles 63 are opened. Buckles 63 thus provide a simple and fast means of releasing the clamping, and this provides for safe use of the device 60.

Figure 12:
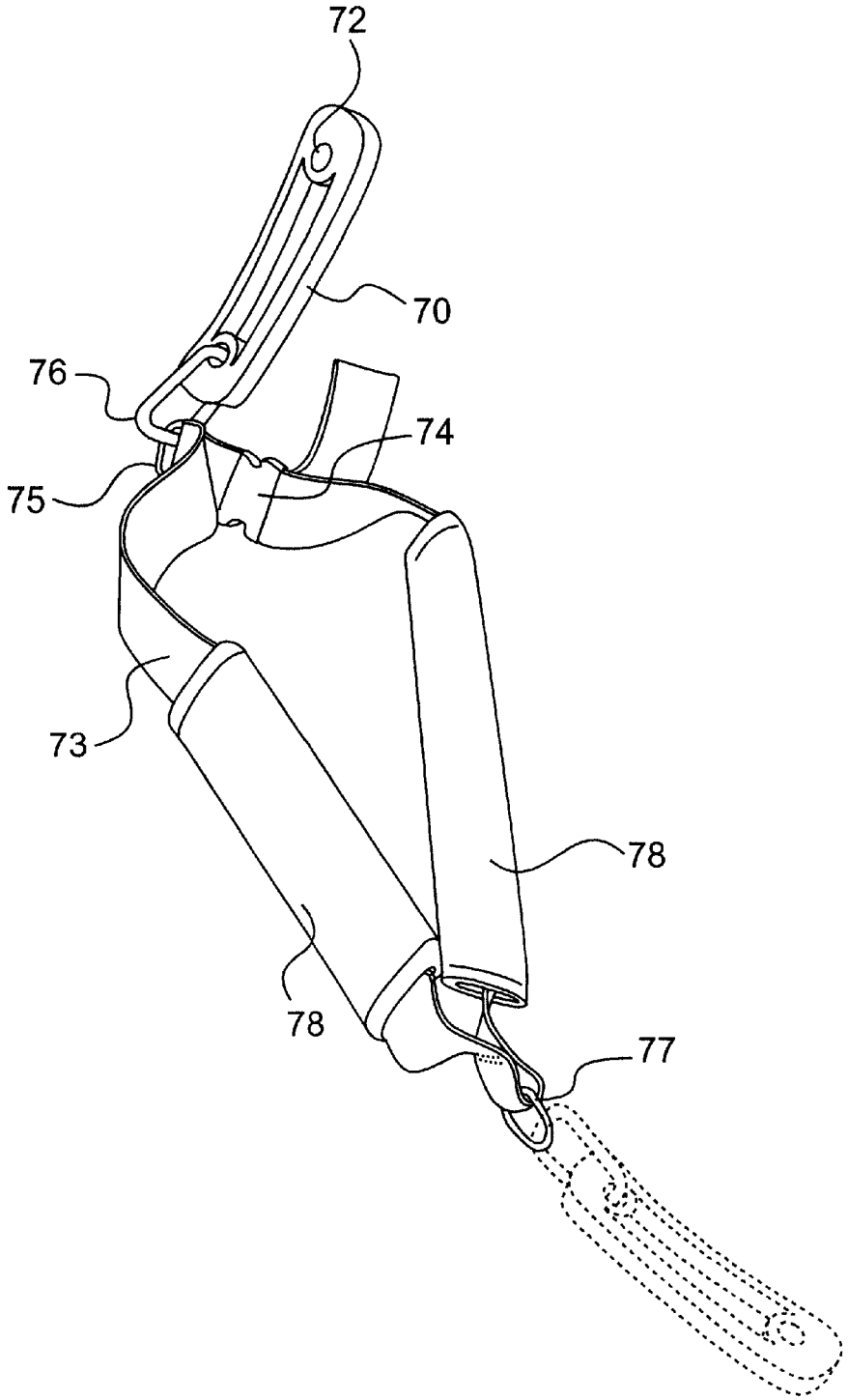
FIG. 12 is a perspective view of an exercise strap constructed according to the principles of the invention.
Figure 13:
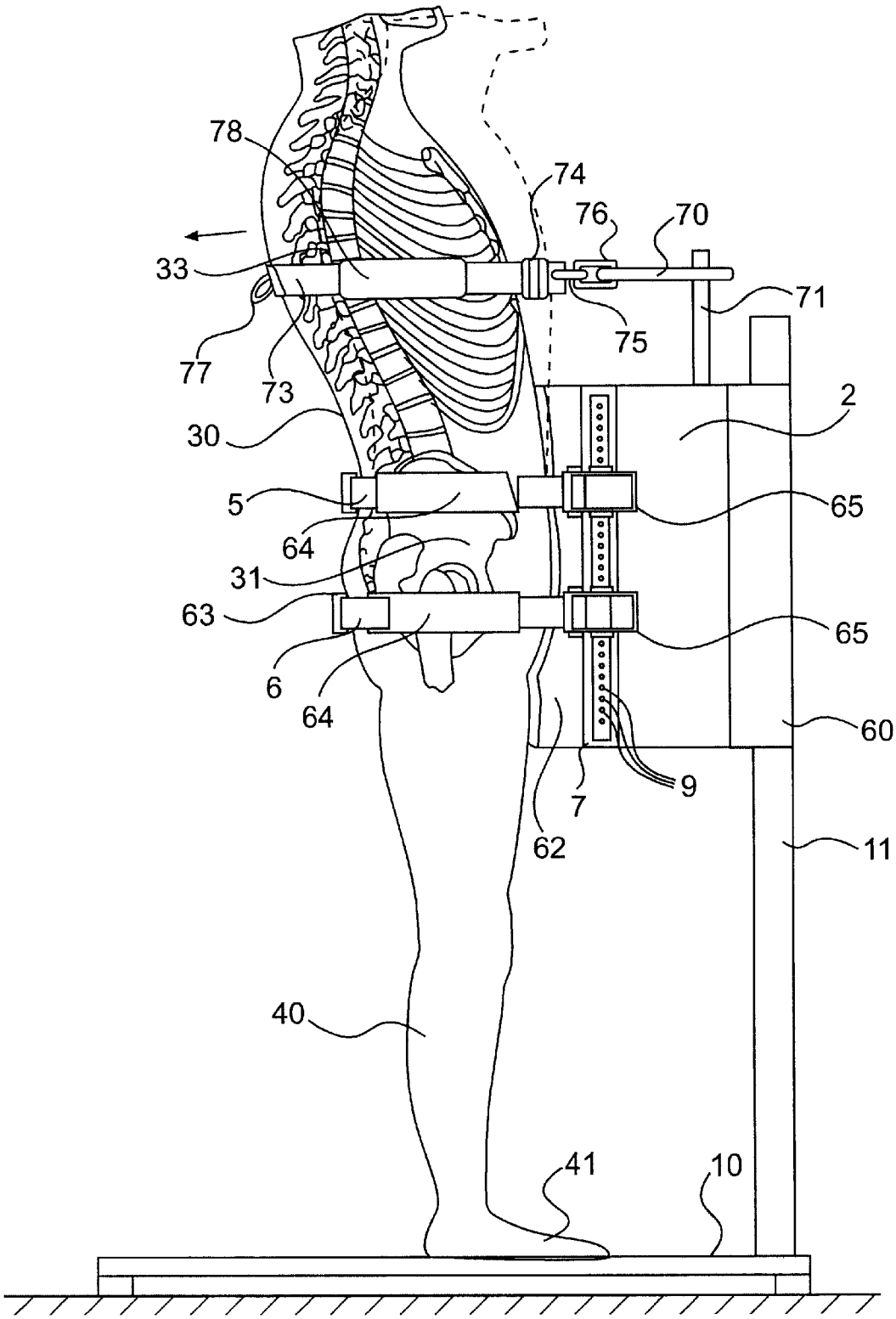
FIGS. 13 and 14 are side, partially cross-sectional views of the strap of FIG. 12 in use with the device of FIG. 8.
Figure 14:
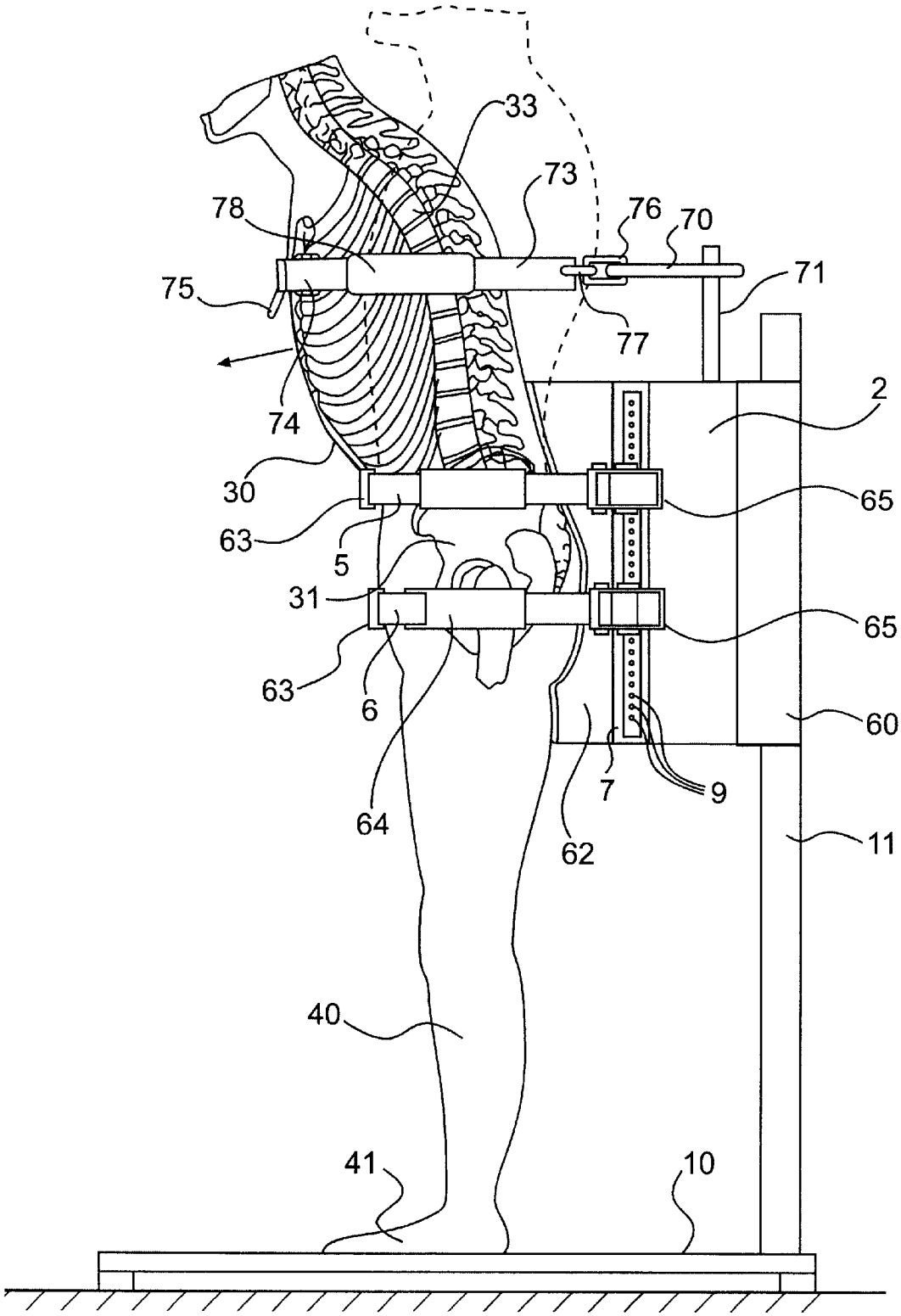

FIGS. 12 to 14 illustrate a resilient arm 70, which may be formed from rubber or other suitable material that can be used to provide for resistance to the user 30 exercising on device 60. Arm 70 has a hole 72 at one end and a ring 76 at the other. It is supported by support pole 71, which in turn is located on support body 2. Arm 70 is coupled to support pole 71 by placing the hole 72 over the pole 71 (FIG. 13). The arm 70 is attached to the user 30 by means of a strap 73 connected to the arm 70 via ring 76. The strap 73 includes a buckle 74 for adjusting the tension in the strap 73. The buckle 74 also facilitates opening the strap 73 to release the user 30. In this example, strap 73—unlike resilient arm 70—is made of a comparatively inelastic material, such as conventional seat belt material. In the alternative, resilient arm 70 could be eliminated, and a modified strap could serve the functions of strap 73 and resilient arm 70. In this case, the modified strap includes a resilient material to provide the resistance to the user 30 exercising on device 60 that otherwise would have been provided by arm 70.

Two connectors are provided along strap 73 for releasably attaching strap 73 to arm 70. The connectors may be in the form of rings 75, 77 for releasable inter-engagement with ring 76 carried by arm 70. One ring 75 is substantially adjacent buckle 74 on strap 73, and the other ring 77 is substantially opposite buckle 74, as illustrated in FIG. 12. When using device 60, the user 30 may be clamped with the front or rear of the pelvis 31 against bolster 62 (FIGS. 13 and 14). When the front of the pelvis 31 is clamped against bolster 62, strap 73 is attached to arm 70 by ring 75. In this case, buckle 74 will be located to the front of the user 30 (FIG. 13) for ease of opening and closing of buckle 74 by the user 30. When the rear of the pelvis 31 is clamped against bolster 62, strap 73 is attached to arm 70 by ring 77. In this way, buckle 74 is again located to the front of the user 30 (FIG. 14) for ease of opening and closing of buckle 74 by the user 30. If a modified strap serving the functions of strap 73 and resilient arm 70 is used, then of course the connections provided along the strap could releasably attach the strap to the support pole 71.

Strap 73 is of a suitable strong, durable material and may include soft pads 78 to prevent discomfort to the user 30 when strap 73 is in use. When the user's pelvis 31 is securely clamped against bolster 62 in a substantially pain-free position, strap 73 is attached to arm 70 and strap 73 is extended around the chest of the user 30. Buckle 74 may then be closed and the tension in strap 73 may be adjusted to suit the user 30. When the user 30 performs exercises, for example bending backwards or forwards, resilient arm 70 provides resistance to the exercising. Exercising of the user's back 33 against the resistance force of arm 70 has a therapeutic effect on the user 30.

A tension gauge may be added to the resistance band and connected to a computer, processor and/or monitor to provide the user with feedback as to the amount of tension, the number of repetitions performed, etc., and/or for data collection. Alternative means of resistance to exercising of the user 30 may be provided, alternatively or additionally to the resilient arm 70. For example, exercise weights may be attached to the user 30, for example by means of a suitable pulley arrangement, to provide a resistance force against user movement.

Figure 15:
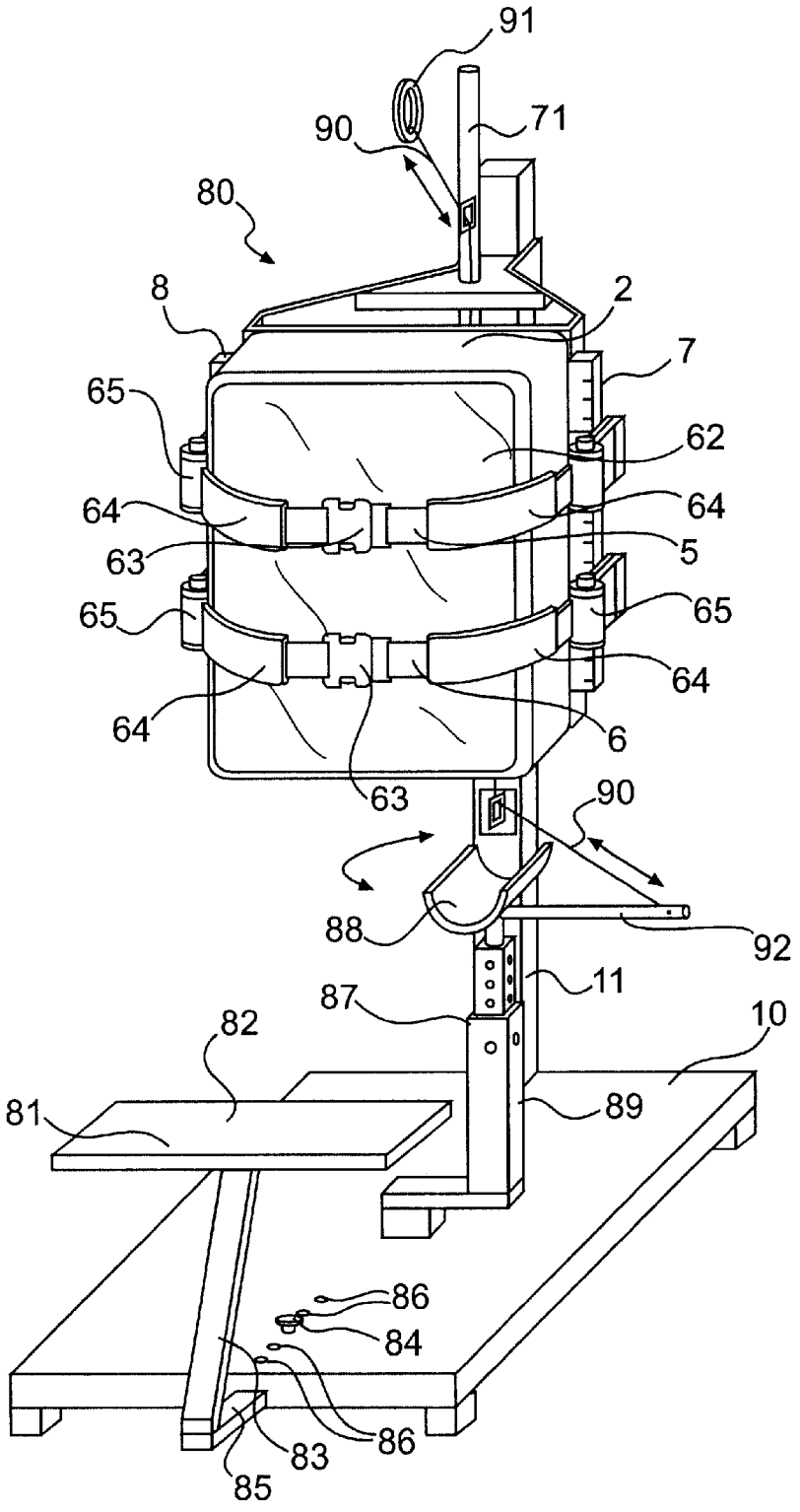
FIG. 15 is a perspective view of a fourth embodiment of a lumbopelvic restraining and exercise device of the invention.
Figure 16:
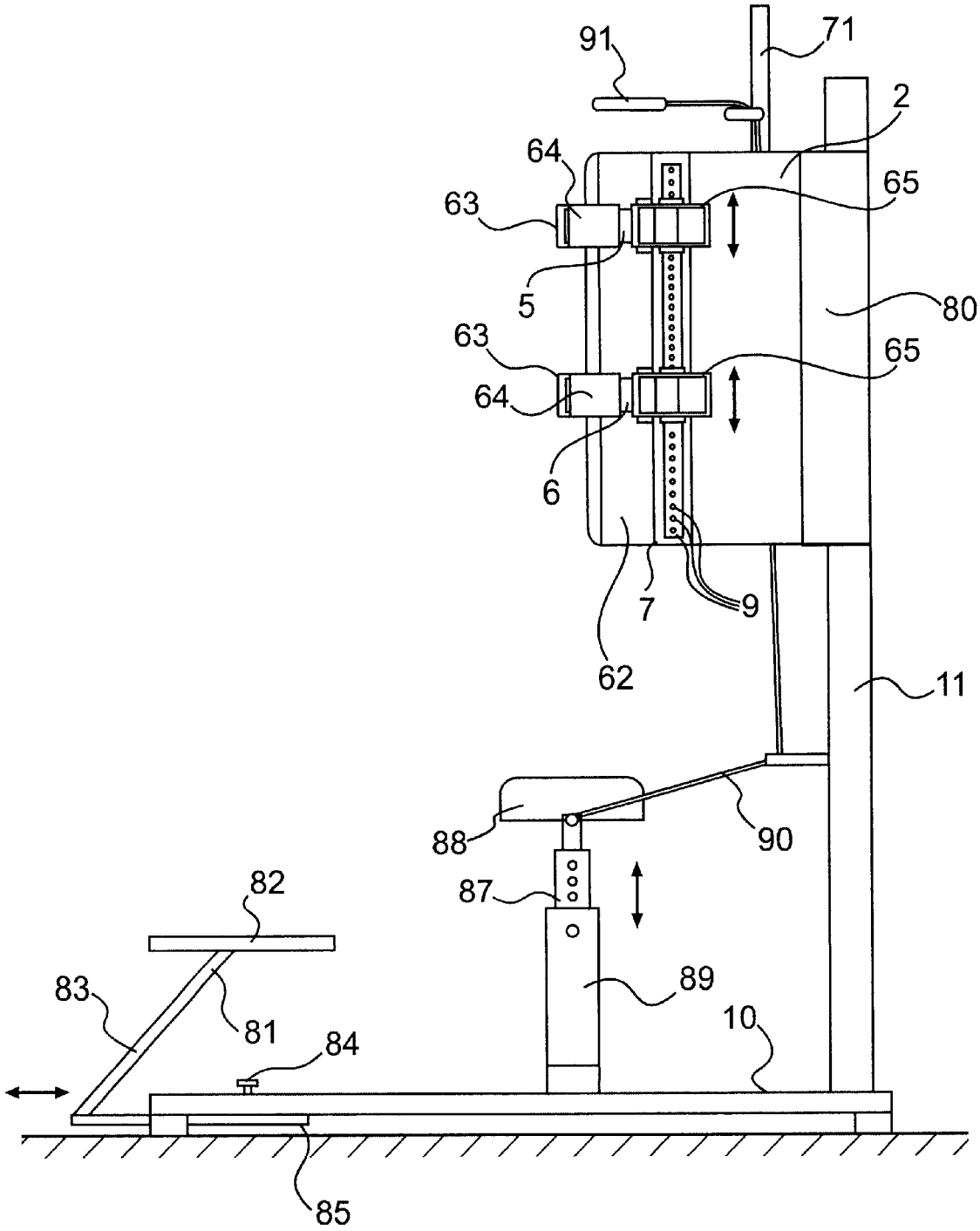
FIG. 16 is a side view of the device of FIG. 15.

FIGS. 15 to 18 illustrate a fourth example of a pelvic restraint and exercise device 80 constructed according to the invention, which is similar to the device 60 of FIGS. 8 to 11. Device 80 includes at least one leg/foot mounting to assist exercising of the leg 40 of the user 30. In particular, device 80 includes a footstool 81 to assist in exercising the user's leg 40. The footstool 81 has a foot platform 82 supported above base 10 by a stem 83. The stem 83 is releasably fixed to base 10 by means of a fixing pin 84 which passes through a hole 86 in base 10 into a root portion 85 of the stem 83 which is located beneath base 10, as illustrated in FIG. 16. A plurality of holes 86 located in base 10 facilitate adjustment of the position of footstool 81 to suit the user 30.

Figure 18:
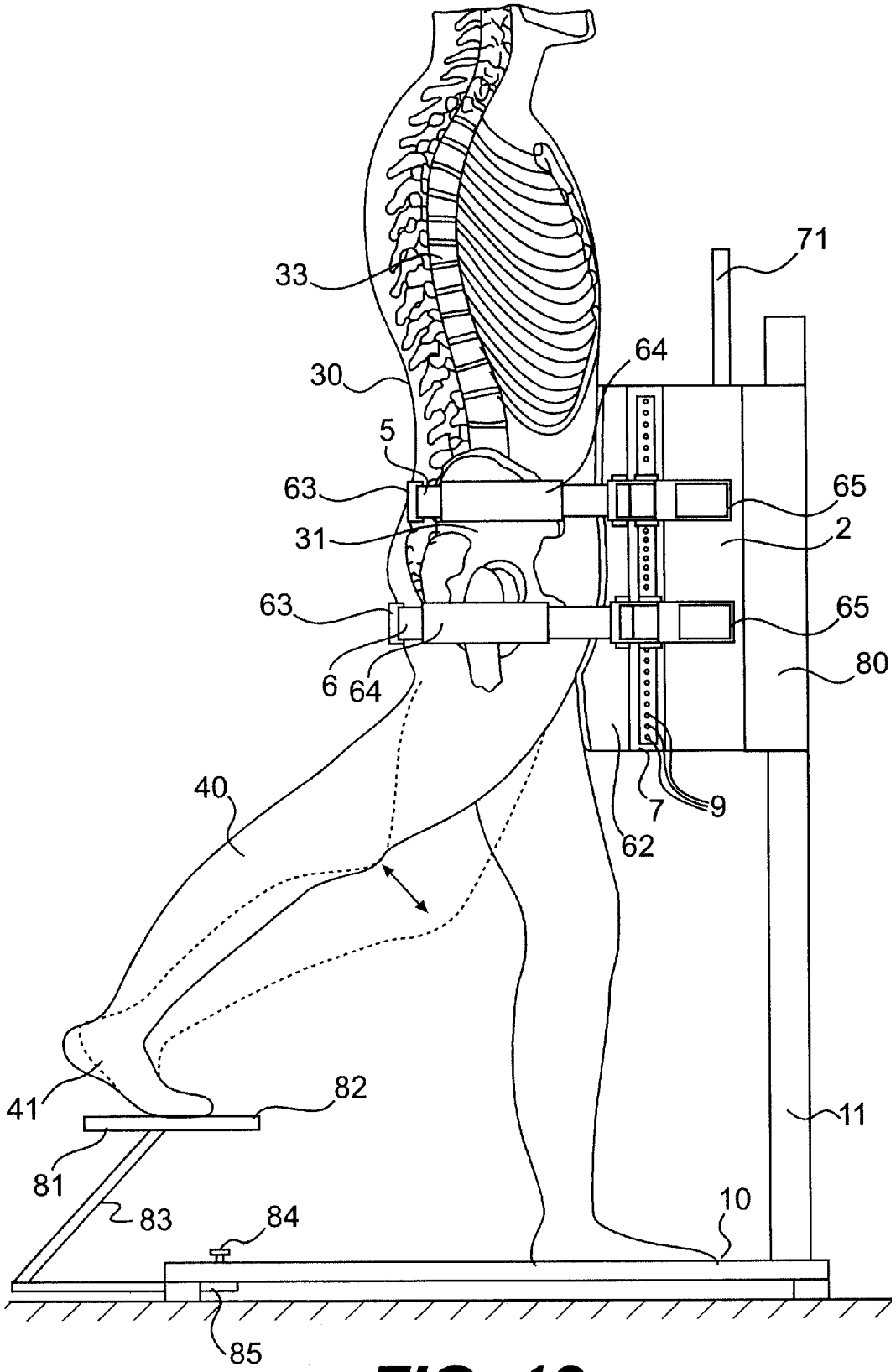

When the user's pelvis 31 has been clamped against the bolster 62 in the substantially pain-free position, the foot 41 of the user 30 is placed upon the platform 82. Footstool 81 may then be used to assist in exercising the user's leg 40, for example by pressing down on the platform 82 with the foot 41 during extension of the leg 40, as illustrated in FIG. 18.

The device 80 also may include a pivotable leg support 87 for twisting the leg 40 of the user 30. The leg support 87 has a curved support surface 88 substantially parallel to the base 10 for supporting a knee or lower leg of the user 30, the support surface 88 being held above the base 10 by a stem 89. The support surface could take on other shapes, such as V-shaped, which has been found to increase friction between the user's leg and the leg support 87 and facilitate the exercises described below. The height of the stem 89 is selectively adjustable to suit the user 30 by means of a telescoping arrangement of an inner portion of the stem 89 within an outer portion of the stem 89 (FIG. 15). The support surface 88 is rotatable relative to the stem 89 for exercising the leg 40 of the user 30 by twisting.

A connector 90 is provided to facilitate pivoting of the support surface 88, thereby twisting of the user's leg 40. One end of the connector 90 is attached to the support surface 88 and the other end has a handle 91 for gripping by the user 30. The connector 90 is passed from the support surface 88 through a series of eyelets on the leg 11 to locate the handle 91 above the bolster 62, as illustrated in FIG. 15. A lever arm 92 is provided to attach the connector 90 to the support surface 88, the connector 90 being attached to the end arm 92 that is farther from the pivot axis of the support surface 88. This arrangement increases the mechanical advantage of the system when a user pulls on the connector 90 to pivot the support surface 88 and thus twist the user's leg 40.

Figure 17:
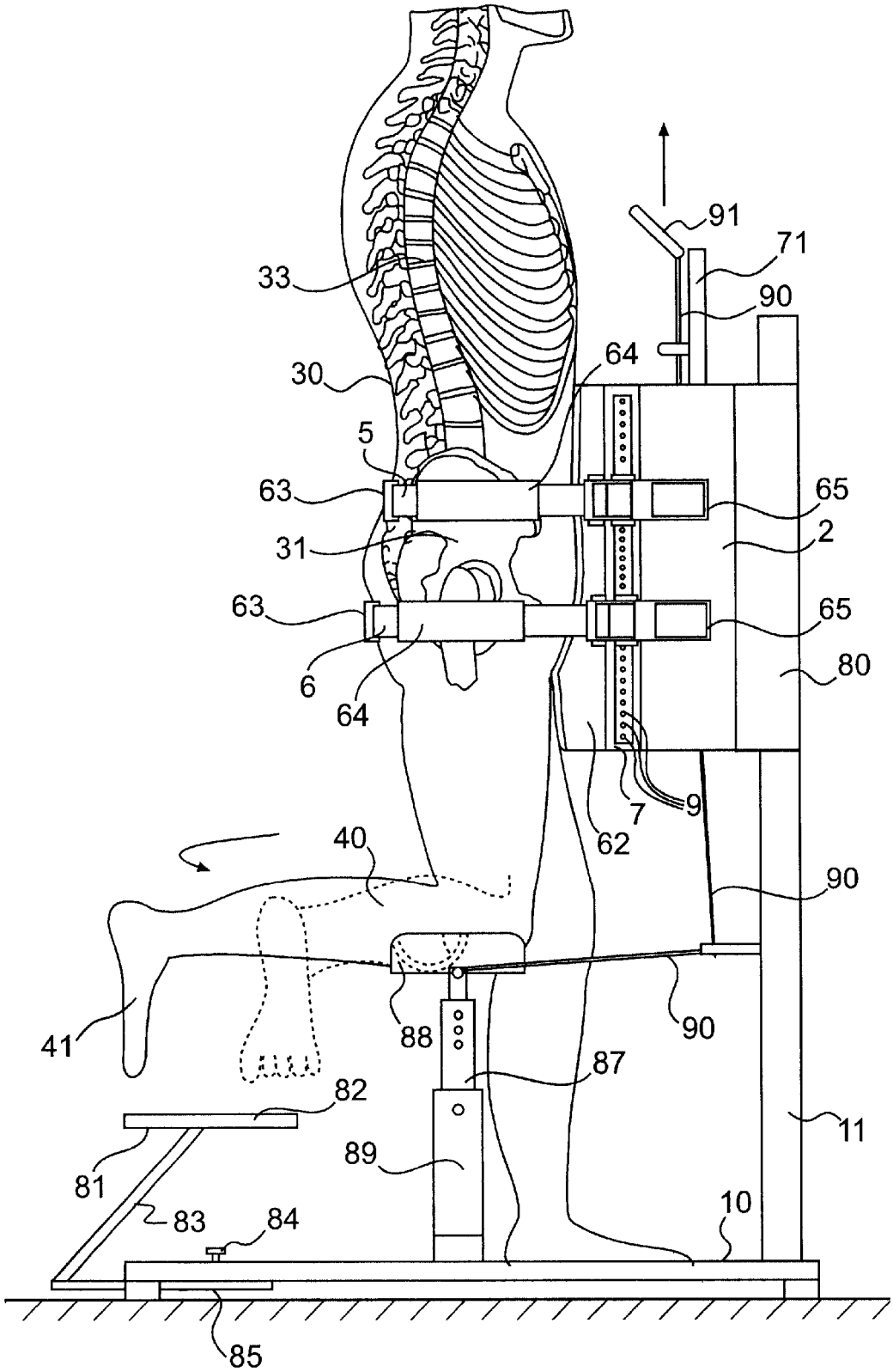
FIGS. 17 and 18 are side, partially cross-sectional views of the device of FIGS. 15 and 16 in use.

When the user's pelvis 31 has been securely clamped against the bolster 62 in a substantially pain-free position, the user 30 bends one knee and rests the bent knee in the support surface 88. By pulling on the connector 90 at the handle 91, the support surface 88 is pivoted about the stem 89, and thereby the leg 40 of the user 30 is twisted, as illustrated in FIG. 17. This twisting action will have a therapeutic effect on the user 30.

It will be appreciated that the leg support 87 may be provided at any location on the base 10 for twisting of either of the user's legs 40. Additionally, connector 90 can be eliminated and arm 92 extended to form approximately a right angle such that its end that is farthest from support surface 88 is substantially perpendicular to the base 10 and within reach of an arm of user 30. The support surface 88 may be pivoted by alternative actuating means, such as by an electro-mechanical means or by any other suitable means. Suitable controlling means may be provided for controlling the pivoting of the support 88.

Figure 19:
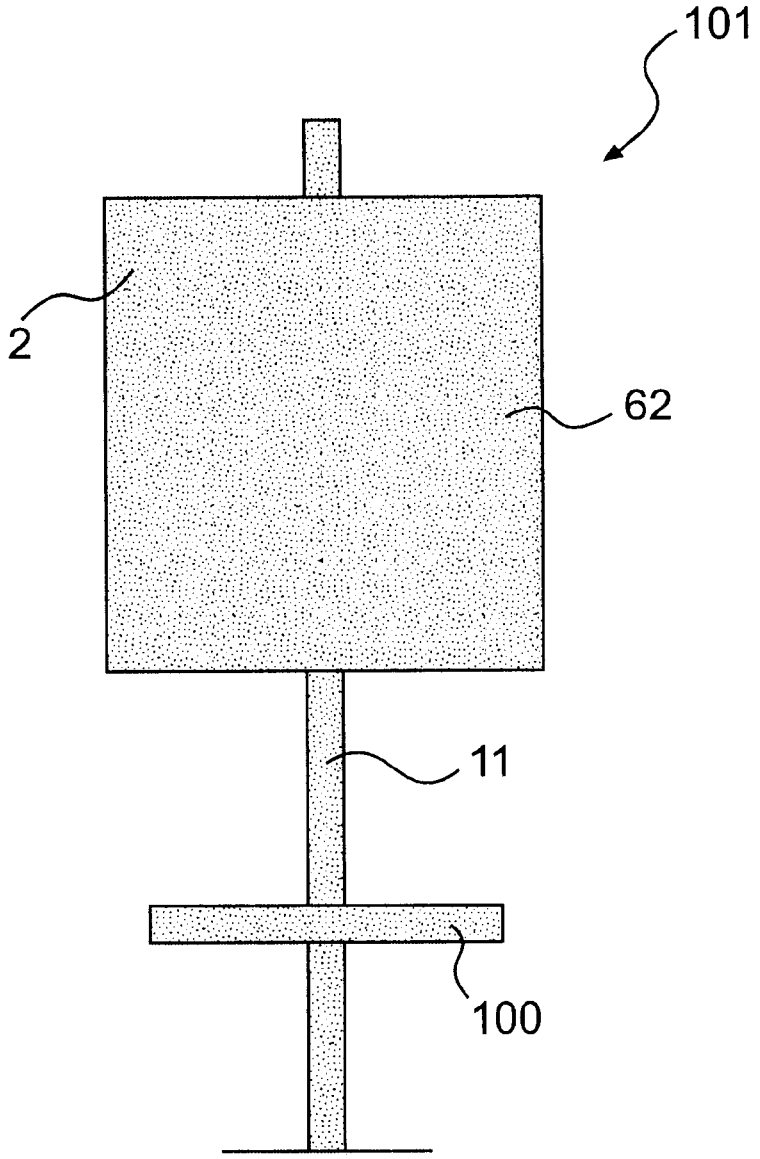
FIG. 19 is a front view of part of a fifth embodiment of the invention.

FIG. 19 illustrates a fifth example of a device 101 constructed according to the invention, which is similar to the device 60 of FIGS. 13 and 14. In this case, the device 101 has an attachment bar 100 extending laterally from each side of the leg 11, for example by about 20 cm. from each side. The bar 100 may be used to support the resilient arm 70, which is attached to the user's leg 40 by the strap 73, in a manner similar to that described previously with reference to FIGS. 13 and 14. The position of the bar 100 on leg 11 is adjustable along leg 11.

In use, hole 72 in arm 70 is slotted around bar 100. When the user's pelvis 31 is securely clamped against bolster 62 in a substantially pain-free position, strap 73 is attached to arm 70, and strap 73 is extended around the user's leg 40. Buckle 74 is then closed, and the tension in strap 73 may be adjusted to suit the user 30. As the user 30 performs exercises, for example leg extensions, resilient arm 70 provides resistance. In this manner, exercising of the user's leg 40 against the resistance force of the arm 70 has a therapeutic effect on the user 30.

It will be appreciated that resilient arm 70 may alternatively be attached to bar 100 by means of loops or hooks provided along bar 100. The position of the attachment loops/hooks may be adjustable, and/or a plurality of loops/hooks may be provided along bar 100 to enable adjustment of the position of resilient arm 70 to suit the user 30. Because bar 100 is adjustable, strap 73 can be placed around different body parts, including the upper back, neck, legs, and arms. Rather than having an adjustable bar 100, multiple attachment points may be placed at any number of countless different positions on any of the devices described in the accompanying Figures. This gives the user many options. A single strap 73 may be attached at any one of the attachment points, thus allowing the user to exercise different parts of the body. In the course of exercising a given part of the body, strap 73 could be moved to different attachment points so that the angle at which strap 73 approaches the body changes. Multiple straps 73 could also be used, permitting the user to exercise multiple parts of the body simultaneously.

Other resistance devices may be provided instead of, or in addition to, strap 73 and resilient arm 70. For example, exercise weights may be utilized. A suitable pulley arrangement could allow for the user 30 to lift the weights while stabilized in any of the devices described in this patent.

Although the above descriptions are directed to various embodiments of the invention, other variations and modifications may be made without departing from the spirit and scope of the invention. For example, the devices in the accompanying Figures may be configured for use by a user in a horizontal lying position instead of a vertical standing position. In this case, the device may be provided on, or as part of, a treatment table or bed. Alternatively the device may be configured for use by a user inclined at any suitable angle. The angle may be selectively adjustable to suit the needs of the user. The device also may be configured for use by a user in a seated position. For example, a seat could be placed below support body 2 shown in FIG. 8. The support pad 2 could be movable in any direction and subject to gravity or mechanical forces to move, or to variable resistance forces provided by, for example, suitable springs, elastic bands or a pulley system with weights.

Straps 5, 6 could also vary—in number, design, and arrangement. One, two, three, four, five, six or more additional straps could be utilized to restrain additional parts of the body (for example, upper back, neck, arms, legs). The additional straps could be coupled to the device in the same manner as straps 5, 6. A tension gauge or similar mechanism could be provided to allow the user to determine the tension in the straps.

In another example, any of the disclosed devices could be altered to include a processor, software and a read-out device. The device could be programmed to provide work-out routines, instructions, treatment charts, to monitor the treatments and the user (e.g., heart rate, blood pressure, body temperature), or even to provide audio or visual entertainment.

The devices disclosed in the accompanying Figures also could be used with a person who is clamped with the rear or side of his/her pelvis against the support surfaces, instead of the front of his/her pelvis, as illustrated in the drawings.

Although the devices of the accompanying Figures may be used to treat a person suffering from back pains or disorders (e.g., back disorder in the region of the cervical spine/thoracic spine/lumbar spine/sacro-iliac joint/pelvis/hip-joint), they may be used in other ways and for other purposes. Indeed, rather than restraining the pelvis, other parts of the body could be stabilized, including the thoracic spine, chest, and shoulder regions. After immobilizing, for example, the chest, the pelvis could be exercised. After immobilizing the shoulder area, arm exercises could be performed. The devices need not even be used for therapeutic purposes or by a person suffering from back discomfort. It could be used as a prophylactic device to help prevent back complaints or back disorders from developing. The invention can also be used for strength and flexibility purposes, for example, to increase range of motion, such as in a golfer's back swing; or even as a warm-up or cool-down in conjunction with another exercise routine or athletic activity.

Again, these examples are merely illustrative and are not meant to be an exhaustive list of all possible designs, implementations, modifications, and uses of the invention. Moreover, features described in connection with one embodiment of the invention maybe used in conjunction with other embodiments, even if not explicitly stated above.

What is claimed is:

1. A method of using an exercise device having a support surface for supporting a portion of a person's body and a restraining member for restraining the body portion to treat acute or chronic pain and/or increase range of motion, said method comprising the steps of:

positioning a portion of the person's body against the support member;

placing the restraining member over the portion of the person's body; and incrementally adjusting the restraining member so as to position and restrain the body portion in any of a number of three-dimensional orientations to lessen the pain.

2. The method of claim 1, wherein the restraining member is placed over a portion of the person's body by a second person.

3. The method of claim 1, wherein the restraining member is placed over a portion of the person's body by the person positioned against the support member.

4. The method of claim 1, wherein the restraining member is adjusted by the person positioned against the support member.

5. The method of claim 1, wherein the restraining member is adjusted by a second person.

6. The method of claim 1, wherein the restraining member is adjusted so as to restrain the body portion in a substantially pain-free position.

7. The method of claim 1, wherein the incremental adjustments cause the body portion to rotate after it has been at least partially secured against the support member.

8. The method of claim 7, wherein the body portion rotates along at least two different axes.

9. The method of claim 1, wherein one of the ways that the restraining member is adjusted is by making independent adjustments to the tightness of the restraining member from two different portions of the restraining member.

10. The method of claim 6, further comprising the step of:

evenly adjusting the tightness of the restraining member from the different portions of the restraining member so as to substantially keep the person's body restrained in the substantially pain-free position.

11. The method of claim 1, further comprising the step of:

adjusting a second restraining member so as to position and restrain the body portion.

12. The method of claim 1, further comprising the step of the user performing exercises while the body portion is being restrained from movement.

13. The method of claim 1, wherein the body portion is repositioned into a different three-dimensional position after being initially restrained.

14. The method of claim 12, wherein the body portion is repositioned into a different three-dimensional position after exercises are performed.

15. The method of claim 1 wherein the positioning step comprises positioning at least a portion of the person's lumbopelvic region against the support member and the incrementally adjusting step comprises adjusting the restraining member so as to position and restrain the portion of the lumbopelvic region in any of a number of three-dimensional orientations.

16. A method of self-treating acute or chronic pain and/or increasing range of motion using a mechanical support, said method comprising the steps of having a user:

position a portion of the user's body against the support;

place a restraining member over the body portion;

incrementally adjust the restraining member so as to position and retain the body portion in any of a number of three-dimensional orientations to lessen the pain; and perform exercises that direct movement about the restrained body portion.

17. The method of claim 14, wherein the pain is in the lumbopelvic region of the user and the body portion comprises at least a portion of the lumbopelvic region.

18. The method of claim 14, wherein the mechanical support comprises an exercise device and said positioning step comprises positioning a portion of the user's body against the exercise device.

* * * * *

UNITED STATES PATENT AND TRADEMARK OFFICE

CERTIFICATE OF CORRECTION

PATENT NO. : 6,656,098 B2
DATED : December 2, 2003
INVENTOR(S) : Jonathan Hoffman It is certified that error appears in the above-identified patent and that said Letters Patent is hereby corrected as shown below:

Column 16,
Line 39, delete “surface” and insert -- member --.

Signed and Sealed this

Nineteenth Day of October, 2004

JON W. DUDAS
*Director of the United States Patent and Trademark Office*